US008279157B2

(12) United States Patent
Uehara et al.

(10) Patent No.: US 8,279,157 B2
(45) Date of Patent: Oct. 2, 2012

(54) LIQUID CRYSTAL DISPLAY ELEMENT, METHOD OF DRIVING THE SAME, AND ELECTRONIC PAPER USING THE SAME

(75) Inventors: Hirokata Uehara, Kawasaki (JP); Masaki Nose, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1083 days.

(21) Appl. No.: 12/182,486

(22) Filed: Jul. 30, 2008

(65) Prior Publication Data

US 2009/0066628 A1 Mar. 12, 2009

(30) Foreign Application Priority Data

Sep. 11, 2007 (JP) ..... 2007-235135

(51) Int. Cl.
*G09G 3/36* (2006.01)
*G09G 5/10* (2006.01)

(52) U.S. Cl. ..... 345/101; 345/97; 345/89; 345/691

(58) Field of Classification Search ..... 345/87–102, 345/691; 327/172, 175
See application file for complete search history.

(56) References Cited

U.S. PATENT DOCUMENTS

| | | | | |
|---|---|---|---|---|
| 5,521,727 | A * | 5/1996 | Inaba et al. | 345/89 |
| 6,075,511 | A * | 6/2000 | Iwasaki et al. | 345/101 |
| 6,803,899 | B1 | 10/2004 | Masazumi et al. | |
| 6,804,029 | B2 * | 10/2004 | Kondoh et al. | 358/3.01 |
| 2008/0099723 | A1 | 5/2008 | Nose et al. | |

FOREIGN PATENT DOCUMENTS

| | | | |
|---|---|---|---|
| JP | 05-297350 | A | 11/1993 |
| JP | 2001-100182 | A | 4/2001 |
| JP | 2002-297111 | A | 10/2002 |
| WO | 2007/004280 | A1 | 1/2007 |

* cited by examiner

*Primary Examiner* — Bipin Shalwala
*Assistant Examiner* — Steven Holton
(74) *Attorney, Agent, or Firm* — Westerman, Hattori, Daniels & Adrian, LLP

(57) ABSTRACT

A method of driving a liquid crystal display element that applies an AC pulse voltage to drive liquid crystal includes: when the temperature of the liquid crystal is higher than a reference temperature, generating the AC pulse voltage for high temperature having a pulse width that is shorter than a reference pulse width of a reference AC pulse voltage used at the reference temperature; and applying the generated AC pulse voltage to the liquid crystal in a period that is equal to the reference pulse width.

18 Claims, 15 Drawing Sheets

FIG.1

| TEMPERATURE (°C) | | -20 ~-10 | -10~ 0 | 0~ 5 | 5~ 10 | 10~ 15 | 15~ 20 | 20~ 25 | 25~ 30 | 30~ 40 | 40~ 50 | 50~ 60 | 60~ 70 |
|---|---|---|---|---|---|---|---|---|---|---|---|---|---|
| PULSE WIDTH RATIO | | 96 | 24 | 6 | 4 | 2 | 1.5 | 1.25 | 1 | 0.75 | 0.5 | 0.5 | 0.5 |
| PULSE WIDTH (msec) | DURING RESET | 5760 | 1440 | 360 | 240 | 120 | 90 | 75 | 60 | 45 | 30 | 30 | 30 |
| | DURING DISPLAY OF IMAGE | 316.8 | 79.2 | 19.8 | 13.2 | 6.6 | 4.95 | 4.125 | 3.3 | 2.475 | 1.65 | 1.65 | 1.65 |

LIQUID CRYSTAL DISPLAY ELEMENT, METHOD OF DRIVING THE SAME, AND ELECTRONIC PAPER USING THE SAME

BACKGROUND

1. Field

The present invention relates to a liquid crystal display element that drives cholesteric liquid crystal to display an image, a method of driving the same, and an electronic paper using the same.

2. Description of the Related Art

In recent years, electronic papers have been actively developed. For example, a reflective display element using a cholesteric-phase liquid crystal composition (hereinafter, referred to as cholesteric liquid crystal) has been used for the electronic paper. The reflective display element using the cholesteric liquid crystal has a memory display function of semipermanently displaying an image even when no power is supplied, and has good display characteristics, such as a clear color display characteristic, a high contrast characteristic, and a high-resolution display characteristic.

Since the reflective display element using the cholesteric liquid crystal has such display characteristics, it can be appropriately used as a display unit of an electronic paper, a mobile terminal, or a portable device, such as an IC card.

Further, the reflective display element using the cholesteric liquid crystal can be used as an outdoor advertising board that uses the memory display function to display a large image, such as an advertisement image, out of doors for a long time without consuming power and displays another image after a predetermined time has elapsed. See Patent document 1: Japanese laid-open patent application No. 2001-100182.

The reflective display element using the cholesteric liquid crystal performs grayscale display by changing the voltage value or the pulse width of a pulse voltage applied to the liquid crystal.

However, response characteristics of the liquid crystal depend on the temperature. When voltage application conditions (the voltage value and the pulse width of a pulse voltage) that have been set to perform optimum grayscale display at room temperature are applied to a display process at high temperature without any change, a deep image is displayed since the response characteristics of the liquid crystal at high temperature are higher than that at room temperature.

Therefore, it is necessary to adjust the voltage application conditions to the liquid crystal according to a temperature variation. The temperature compensation of the response characteristics of the liquid crystal is performed by a pulse width modulation method rather than a voltage modulation method in order to reduce costs. The pulse width modulation method applies a pulse voltage with a pulse width that is shorter than that at room temperature to the liquid crystal at high temperature, without changing the value of the voltage applied to the liquid crystal. Therefore, the transmission rate of image data transmitted from a processor to a driver control circuit of a liquid crystal display element at high temperature needs to be higher than that at room temperature. In this case, it is necessary to provide a high-speed transmission driver and receiver in correspondence with an increase in the processing load of the processor. As a result, the manufacturing costs of an apparatus increase.

SUMMARY OF THE INVENTION

According to an aspect of an embodiment, there is provided a method of driving a liquid crystal display element that applies an alternating current (AC) pulse voltage to drive liquid crystal. The method includes: comparing the temperature of the liquid crystal with a reference temperature; when the temperature of the liquid crystal is higher than the reference temperature, generating the AC pulse voltage for a high temperature having a pulse width that is shorter than a reference pulse width of a reference AC pulse voltage used at the reference temperature; and applying the AC pulse voltage for the high temperature to the liquid crystal in a period that is equal to the reference pulse width.

BRIEF DESCRIPTION OF THE DRAWINGS

FIG. 1 is a diagram illustrating voltage application conditions to liquid crystal when the temperature compensation of response characteristics of cholesteric liquid crystal is performed by a pulse width modulation method;

Figure 2:
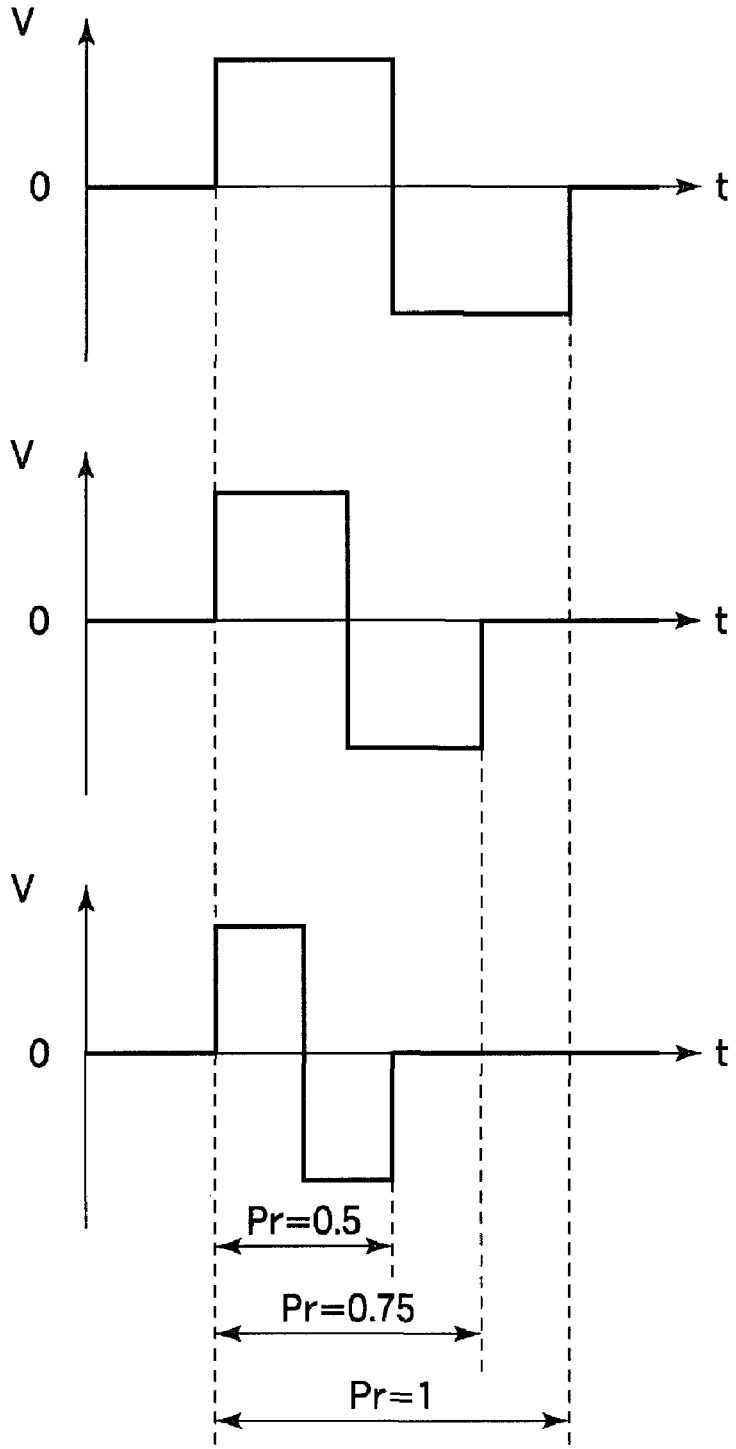
FIG. 2 is a diagram illustrating the waveforms of voltages applied when the temperature compensation of the response characteristics of the cholesteric liquid crystal is performed by the pulse width modulation method.

DESCRIPTION OF THE PREFERRED EMBODIMENTS (Driving Principle)

First, the driving principle of a liquid crystal display element according to an embodiment will be disclosed with reference to FIGS. 1 to 4. The liquid crystal display element according to this embodiment uses cholesteric liquid crystal whose state is changed between a planar state that selectively reflects specific visible light and a focal conic state that transmits visible light when the strength of an electric field applied to the liquid crystal varies.

FIG. 1 shows the voltage application conditions to the liquid crystal when the temperature compensation of response characteristics of the liquid crystal is performed by a pulse width modulation method. In this embodiment, an alternating current (AC) pulse voltage of ±36 V is applied to the liquid crystal during a reset process, an AC pulse voltage of ±20 V is applied to the liquid crystal during black display, and an AC pulse voltage of ±10 V or less is applied to the liquid crystal in order to maintain display. These voltage values are constant regardless of a variation in the temperature of the liquid crystal. The term 'reset' means changing the state of the cholesteric liquid crystal to a homeotropic state and then changing the homeotropic state to the planar state. In this embodiment, white display is obtained in the planar state, and block display is obtained in the focal conic state.

In FIG. 1, an upper chart shows an environmental temperature t (° C.) during the driving of the liquid crystal. Room temperature is in a range of 25° C. to 30° C. In this embodiment, the room temperature is used as a reference temperature. In addition, it is assumed that the environmental temperature t during the driving of the liquid crystal is the temperature of the liquid crystal. In FIG. 1, a middle chart shows a pulse width ratio in each temperature range. The pulse width ratio means the ratio of the pulse width in each temperature range to the pulse width at the room temperature. In FIG. 1, a lower chart shows the pulse width (msec) of the voltage applied to the liquid crystal in each temperature range. In the lower chart, an upper part shows the pulse width during the reset process, and a lower part shows the pulse width during the display of an image (the formation of an image). In the pulse width modulation method, the pulse width increases as the temperature becomes lower than the room temperature, and the pulse width decreases when the temperature becomes higher than the room temperature. At the environmental temperature t lower than the room temperature, a processor load does not increase, which causes no problem. Hereinafter, pulse width modulation at the environmental temperature t that is higher than the room temperature, at which a processor load increases according to the related art will be disclosed.

First, the pulse width modulation during the reset process will be disclosed. As shown in FIG. 1, a reference pulse width Tr of a reference AC pulse voltage during the reset process when the environmental temperature t is a room temperature Hs ($25 \leqq Hs \leqq 30$) is 60 msec. A pulse width Tr1 of an AC pulse voltage for high temperature during the reset process when the environmental temperature t is a high temperature Hh1 ($30 < Hh1 \leqq 40$) is 45 msec. A pulse width ratio Pr (=Tr1/Tr) is 45/60=0.75. A pulse width Tr2 of the AC pulse voltage for high temperature during the reset process when the environmental temperature t is a high temperature Hh2 ($40 < Hh2$) is 30 msec. The pulse width ratio Pr (=Tr2/Tr) is 30/60=0.5.

Next, the pulse width modulation during the display of an image will be disclosed. As shown in FIG. 1, a reference pulse width Td of the reference AC pulse voltage during the display of an image when the environmental temperature t is the room temperature Hs is 3.3 msec. A pulse width Td1 of the AC pulse voltage for high temperature during the display of an image when the environmental temperature t is the high temperature Hh1 is 2.475 msec. The pulse width ratio Pr is 2.475/3.3=0.75. A pulse width Td2 of the AC pulse voltage for high temperature during the display of an image when the environmental temperature t is the high temperature Hh2 is 1.65 msec. The pulse width ratio Pr is 1.65/3.3=0.5.

FIG. 2 shows the waveforms of voltages applied when a variation in the response characteristics of the cholesteric liquid crystal according to the temperature is compensated by the pulse width modulation method. In FIG. 2, the horizontal axis indicates time t, and the vertical axis indicates a voltage level (V). In FIG. 2, an upper timing chart shows the output timing of the voltage (having a pulse width Td) applied to the liquid crystal at the room temperature Hs during the display of an image. In FIG. 2, a middle timing chart shows the output timing of the voltage (having the pulse width Td1) applied to the liquid crystal at the high temperature Hh1. In FIG. 2, a lower timing chart shows the output timing of the voltage (having the pulse width Td2) applied to the liquid crystal at the high temperature Hh2.

In order to prevent the characteristics of the liquid crystal from deteriorating due to the application of direct current (DC) voltage components, generally, an AC voltage having a pulse waveform, which is a combination of a positive pulse and a negative pulse, is applied to the liquid crystal at both the room temperature and the high temperature. The polarity of the reference AC pulse voltage at the room temperature Hs is reversed in the middle of the reference pulse width.

Since the pulse width ratio Pr at the high temperature Hh1 is 0.75, as shown in the middle timing chart of FIG. 2, the pulse width Td1 of the pulse voltage applied is reduced to three-quarters of that at the room temperature Hs. In addition, since the pulse width ratio Pr at the high temperature Hh2 is 0.5, as shown in the lower timing chart of FIG. 2, the pulse width Td2 of the pulse voltage applied is reduced to half the pulse width at the room temperature Hs.

In general, as the pulse width of the voltage applied decreases, the transmission rate of image data from a processor to a drive control circuit increases, and thus a processor load increases during the transmission of the image data. For this reason, the pulse width modulation method according to this embodiment makes the transmission rate of image data from the processor to the drive control circuit equal to that at the room temperature Hs even when the pulse width of the voltage applied is decreased due to an increase in the environmental temperature t.

Figure 3:
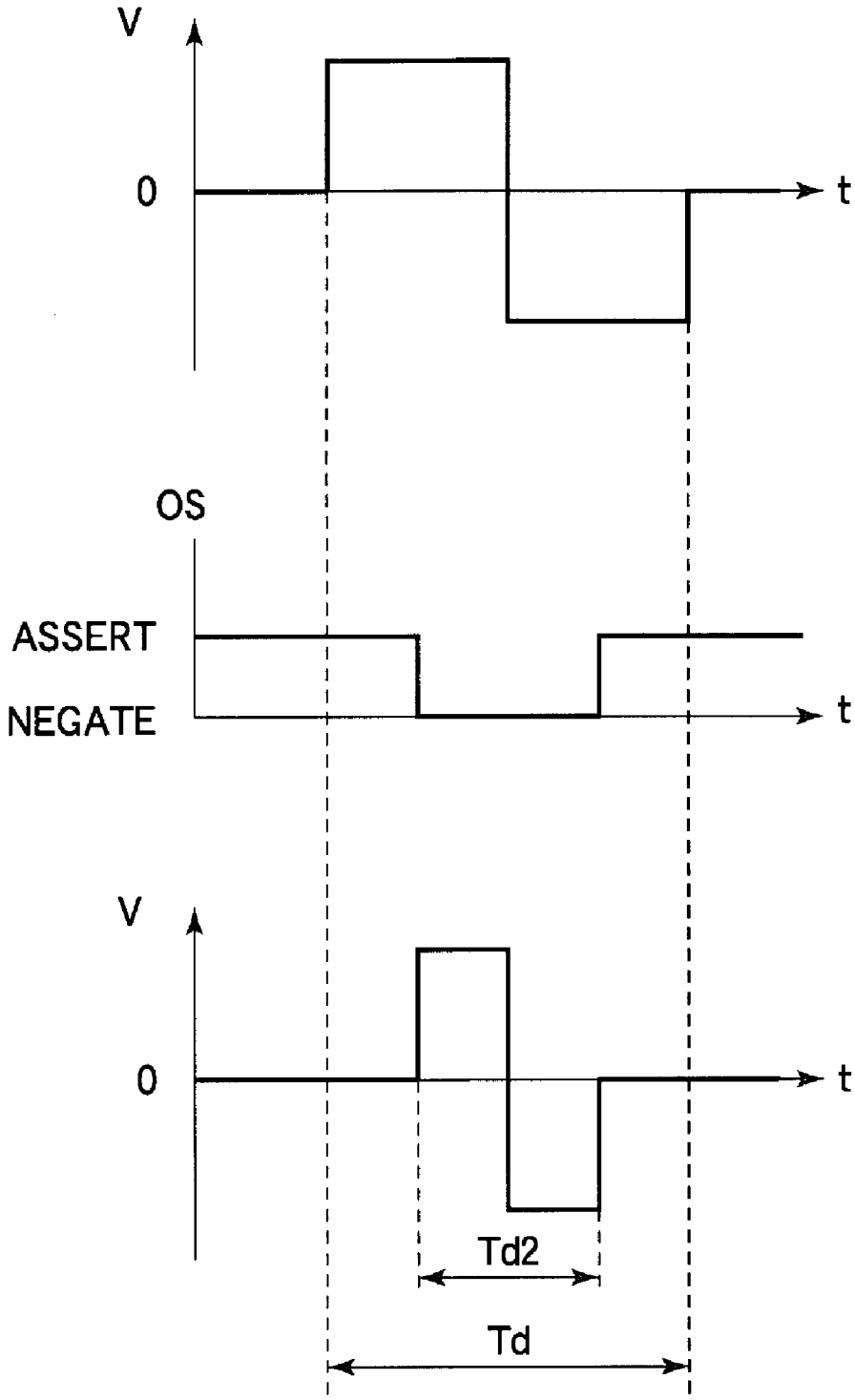
FIG. 3 is a diagram illustrating the driving principle of a liquid crystal display element according to an embodiment.
Figure 4:
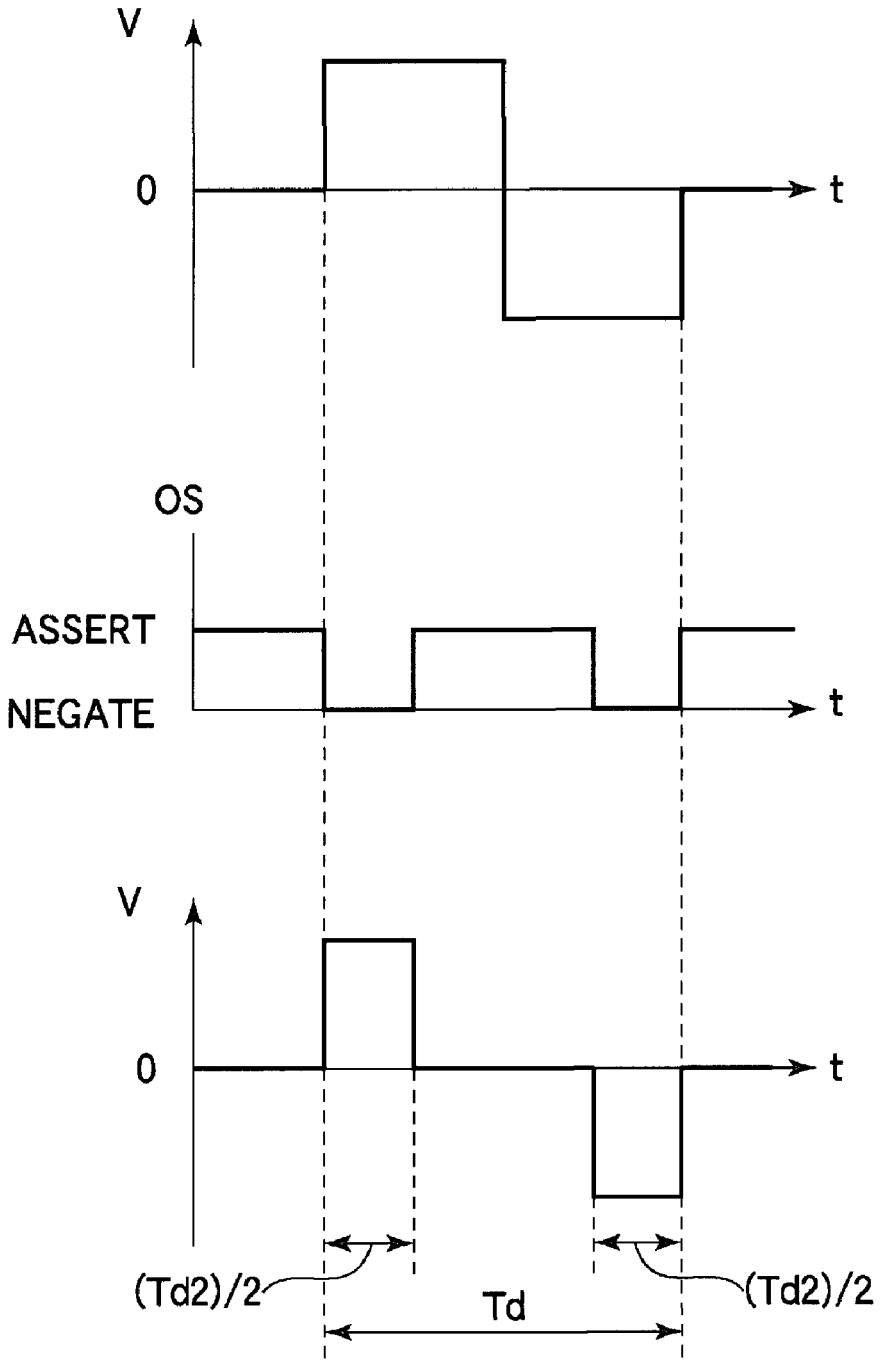
FIG. 4 is a diagram illustrating the driving principle of the liquid crystal display element according to the embodiment.

FIGS. 3 and 4 show temperature compensation control using the pulse width modulation method according to this embodiment. In FIGS. 3 and 4, an upper timing chart shows the output timing of the voltage (having the pulse width Td) applied to the liquid crystal at the room temperature Hs. In FIGS. 3 and 4, a middle timing chart shows the output timing of a voltage cut of f signal OS (hereinafter, referred to as an off signal OS). In FIGS. 3 and 4, a lower timing chart shows the pulse width Td2 required at the high temperature Hh2. In FIGS. 3 and 4, the horizontal axis indicates time (t). In the upper and lower timing charts, the vertical axis indicates a voltage level (V). In the middle timing chart, the vertical axis indicates the asserted state and the negated state of the off signal OS. The off signal OS is enabled in the asserted state, and disabled in the negated state.

When the off signal OS is asserted, the voltage applied to the liquid crystal at the room temperature Hs forcibly turns to a zero level (GND). In addition, when the off signal OS become negated, the voltage applied to the liquid crystal at the room temperature Hs is output to the liquid crystal without any change. It is possible to forcibly turn off (0 (GND) level) the voltage level of the AC pulse voltage at the room temperature Hs during an arbitrary period by adjusting the asserted and negated states of the voltage cut off signal.

In the middle timing chart of FIG. 3, the off signal OS is maintained in the asserted state during the period from a start of the pulse waveform of the voltage applied to the liquid crystal at the room temperature Hs to a quarter of time length of the pulse waveform in the upper timing chart of FIG. 3. In this embodiment, the term 'time length' includes the time point from the start of the waveform.

Then, the off signal OS is maintained in the negated state during the period from a quarter of time length of the pulse waveform to three-quarters of time length of the pulse waveform, and is maintained in the asserted state after the three-quarters of time length of the pulse waveform. In this case, the off signal OS is maintained in the negated state during the time which includes a time point of polarity reversal of the pulse waveform at the room temperature Hs. That is, the off signal OS is asserted separately at both sides of the middle (half) of the pulse width Td at the room temperature Hs where the polarity of the pulse waveform is reversed.

Therefore, the output voltage is forcibly maintained at a zero level (GND) during the first period from the start of the pulse waveform of the voltage applied to the liquid crystal at the room temperature Hs to the quarter of time length of the pulse waveform (first time) before the polarity reversal and the second period from three-quarters of time length of the pulse waveform (second time) after the polarity reversal to the end of the pulse waveform of the voltage. In addition, the waveform from the quarter of time length of the pulse waveform to three-quarts of time length of the pulse waveform is output without any change. The first period and the second period have the same length.

As such, as shown in the lower timing chart of FIG. 3, it is possible to generate a voltage pulse having the pulse width Td2 at the high temperature Hh2 within the time that is equal to the reference pulse width Td at the room temperature Hs and apply the generated voltage to the liquid crystal, by controlling the asserted and negated states of the off signal OS to change the voltage level of the voltage applied to the liquid crystal at the room temperature Hs. Therefore, even when the transmission rate of image data from the processor to the drive control circuit is equal to that at the room temperature Hs, it is possible to apply a voltage waveform having a short pulse width at the high temperature Hh2 from a driver of a liquid crystal display panel.

Further, it is possible to make the width of a positive pulse equal to that of a negative pulse of the generated voltage waveform having a short pulse width by making the time from the start of the negated state of the off signal OS to the polarity reversal of the pulse waveform at the room temperature Hs equal to the time from the polarity reversal of the pulse waveform to the end of the negated state within the pulse width Td at the room temperature Hs.

Similarly, the off signal OS shown in the middle timing chart of FIG. 4 is maintained in the negated state during the period from a start of the pulse waveform shown in the upper timing chart of FIG. 4 to a quarter of time length of the pulse waveform and during the period from three-quarters of time length of the pulse waveform to an end of the pulse waveform, and is maintained in the asserted state during the other periods of the pulse waveform. In this case, the off signal OS is maintained in the asserted state during the time which includes a time point of polarity reversal of the pulse waveform at the room temperature Hs. Therefore, the off signal is forcibly maintained at a voltage of 0 V (GND) from a quarter of time length of the pulse waveform of the voltage applied to the liquid crystal at the room temperature Hs to three-quarters of time length. In addition, the waveform is output without any change during the period from the start to a quarter of time length of the pulse waveform and during the period from three-quarts of time length of the pulse waveform to the end.

As such, as shown in the lower timing chart of FIG. 4, it is possible to generate a voltage pulse having the pulse width Td2 including a positive pulse width of (Td2)/2 and a negative pulse width of (Td2)/2, which are separated from each other with a pulse width of Td/2 therebetween, at the high temperature Hh2 within the time that is equal to the reference pulse width Td at the room temperature Hs, and apply the generated voltage to the liquid crystal, by controlling the asserted and negated states of the off signal OS to change the voltage level of the voltage applied to the liquid crystal at the room temperature Hs. This pulse waveform can also be used to perform temperature compensation at the high temperature Hh2. Therefore, even when the transmission rate of image data from the processor to the drive control circuit is equal to that at the room temperature Hs, it is possible to apply a voltage waveform having a short pulse width at the high temperature Hh2 from the driver of the liquid crystal display panel.

Further, it is possible to make the width of a positive pulse equal to that of a negative pulse of the generated voltage waveform having a short pulse width by making the time from the start of the asserted state of the off signal OS to the polarity reversal of the pulse waveform at the room temperature Hs equal to the time from the polarity reversal of the pulse waveform to the end of the asserted state within the pulse width Td at the room temperature Hs.

As disclosed above, according to this embodiment, an optimum display can be performed at the high temperature Hh2 under the same pulse width modulation conditions as those at the room temperature Hs on the processor side. Since processor can transmit image data to the driver control circuit at the same transmission rate as that at the room temperature Hs, it is possible to compensate for liquid crystal characteristics at the high temperature Hh2 without increasing the processing load of the processor. Therefore, high-speed transmission driver and receiver are not needed, and it is not necessary to provide multiple power supply circuits corresponding to voltage modulation methods. As a result it is possible to manufacture an apparatus at a low cost.

Further, FIGS. 3 and 4 show the pulse width modulation method at the high temperature Hh2 during the display of an image, which is similarly applied to the pulse width modulation method at the high temperature Hh2 during the reset process and the pulse width modulation method at the high temperature Hh1 during the display of an image and during the reset process.

(Embodiments)

Figure 5:
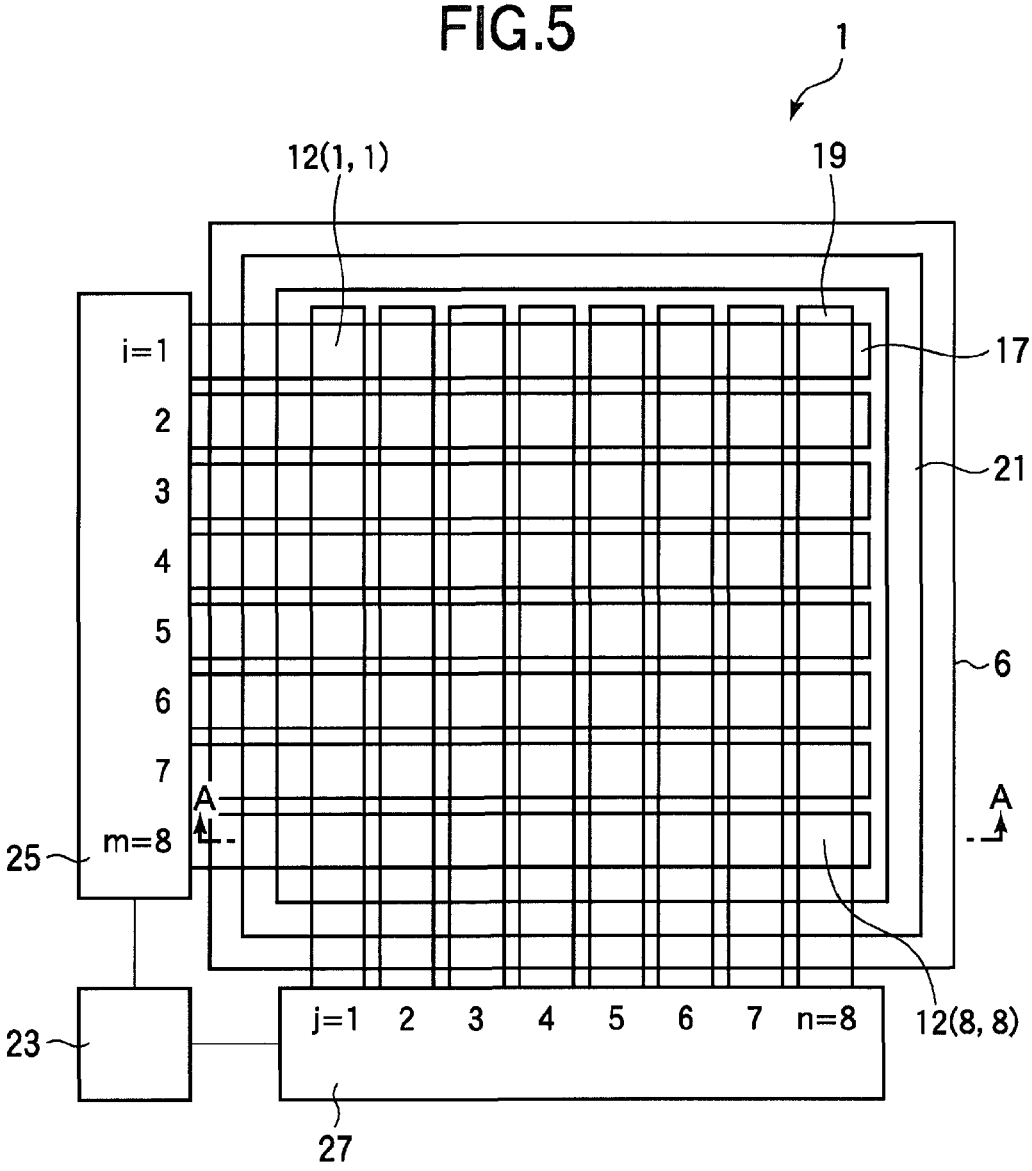
FIG. 5 is a diagram schematically illustrating the structure of the liquid crystal display element according to the embodiment, as viewing a display screen.
Figure 6:
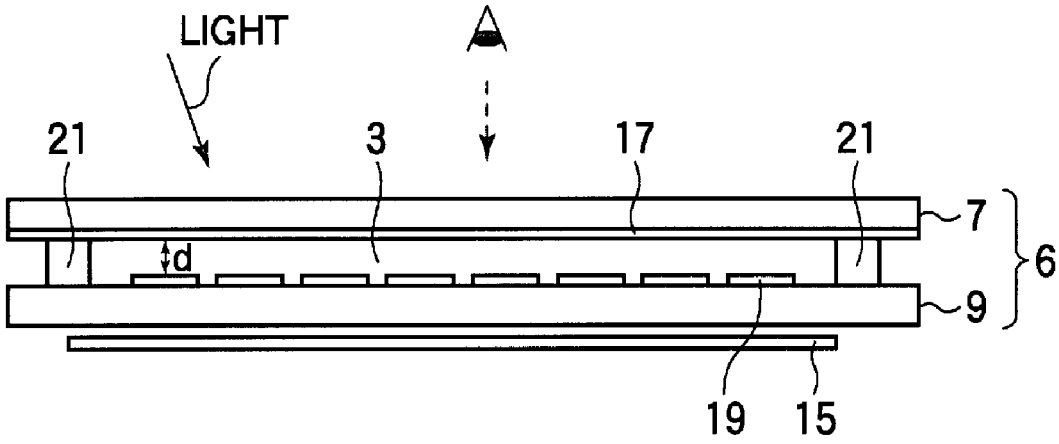
FIG. 6 is a cross-sectional view schematically illustrating the liquid crystal display element according to the embodiment taken along the virtual line A-A of FIG. 5.

Next, the basic structure of the liquid crystal display element according to this embodiment will be disclosed in detail with reference to FIGS. 5 and 6. FIG. 5 is a diagram schematically illustrating the structure of a liquid crystal display element 1 according to this embodiment, as viewing a display screen. FIG. 6 is a cross-sectional view schematically illustrating the liquid crystal display element 1 taken along the virtual line A-A of FIG. 5. In FIG. 6, an upper substrate 7 is a display screen side, and external light (which is represented by a solid line) is incident on the display screen from the upper side of the substrate 7. An observer's eye or an observing direction (which is represented by a dotted line) is schematically illustrated above the substrate 7.

As shown in FIG. 6, the liquid crystal display element 1 includes a pair of upper and lower transparent substrates 7 and 9 that are opposite to each other with a predetermined cell gap d interposed therebetween. As shown in FIGS. 5 and 6, a sealing material 21 is formed in a frame shape along the peripheries of the upper and lower rectangular substrates 7 and 9. The upper and lower substrates 7 and 9 are fixed by the sealing material 21 so as to be opposite to each other. In addition, for example, green (G) cholesteric liquid crystal 3 that selectively reflects green (G) light is sealed between the upper and lower substrates 7 and 9 by the sealing material 21. A light absorbing layer 15 is provided on the rear surface of the lower substrate 9. Further, the lower substrate 9 may be colored and serve as a light absorbing layer without providing the light absorbing layer 15.

Scanning electrodes 17 are formed on the surface of the upper substrate 7 facing the liquid crystal 3, and data electrodes 19 are formed on the surface of the lower substrate 9 facing the liquid crystal 3. The electrodes 17 and 19 are both formed of a transparent electrode material. As shown in FIG. 5, the scanning electrodes 17 extend in the horizontal direction of FIG. 5 in stripe shapes, as viewing the upper and lower substrates 7 and 9 in the normal direction of the display screen. In addition, i rows (i=1 to m; in this embodiment, m=8) of scanning electrodes 17(i) are arranged in parallel to each other from the upper side to the lower side in FIG. 5. As shown in FIG. 5, the data electrodes 19 are provided so as to extend in stripe shapes in the vertical direction of FIG. 5. In addition, the data electrodes 19 intersect the scanning electrodes 17 and are opposite to the scanning electrodes 17 with the liquid crystal 3 interposed therebetween. Further, j columns (j=1 to n; in this embodiment, n=8) of data electrodes 19(j) are arranged in parallel to each other from the left side to the right side in FIG. 5. Pixels 12 are provided at intersections of the electrodes 17 and 19. A plurality of pixels 12(i, j) arranged in a matrix of m rows by n columns form the display screen. A liquid crystal display panel 6 is manufactured by the above-mentioned components.

The cholesteric liquid crystal 3 is a liquid crystal compound that is obtained by adding a relatively large amount of chiral additive (which is referred to as a chiral material), that is, several tens of percent by weight (for example, about 10 to 40 wt %) of chiral additive to nematic liquid crystal. The content of the chiral material is a value when the sum of the content of a nematic liquid crystal component and the content of the chiral material is 100 wt %. When a relative large amount of chiral material is contained in the nematic liquid crystal, it is possible to form a cholesteric phase in which nematic liquid crystal molecules are strongly twisted in a spiral shape. The cholesteric liquid crystal is also called chiral nematic liquid crystal. The cholesteric liquid crystal has bistability (memory effects). After an electric field is applied, the cholesteric liquid crystal is changed to a planar state, a focal conic state, or an intermediate state, which is a mixture of these states, and then stably maintains its state even when no electric field is applied.

The planar state of the liquid crystal 3 is obtained by a reset process. That is, the planar state is obtained by applying a relatively high voltage between the upper and lower electrodes 17 and 19 for a predetermined time to generate a strong electric field in the liquid crystal 3 between the upper and lower electrodes 17 and 19, thereby changing the state of the liquid crystal 3 to a homeotropic state, and rapidly weakening the electric field. In this embodiment, a voltage of ±36 V is applied to the liquid crystal 3 in order to reset the liquid crystal.

The liquid crystal molecules in the planar state are sequentially rotated in the thickness direction between the upper and lower electrodes 17 and 19 opposite to each other to form a spiral structure, and the spiral axis of the spiral structure is substantially vertical to the electrode surfaces of the upper and lower electrodes 17 and 19. In the planar state, light in a predetermined wavelength range corresponding to the spiral pitch of the liquid crystal molecules is selectively reflected from a liquid crystal layer. In this case, the reflected light becomes right or left circularly polarized light according to the optical rotatory power of the spiral pitch, and the other light components pass through the liquid crystal layer. Natural light includes left and right circularly polarized light components. Therefore, it is considered that, when natural light is incident on the liquid crystal in the planar state, 50% of the incident light in a selected wavelength range is reflected, and the remaining 50% of light passes through the liquid crystal. When the average refractive index of the liquid crystal is n and the spiral pitch is p, a wavelength $\lambda$ where the largest amount of light is reflected is represented by $\lambda=n\cdot p$. Therefore, in order to selectively reflect green light from the liquid crystal 3 in the planar state, the average refractive index n and the spiral pitch p are determined such that the wavelength $\lambda$ falls within a range of, for example, 540 to 550 nm. The average refractive index n and the optical rotatory power can be adjusted by selecting a liquid crystal material and a chiral material, and the spiral pitch p can be adjusted by adjusting the content of a chiral material.

For example, the focal conic state is obtained by applying a weak electric field that is weaker than the above-mentioned strong electric field to the liquid crystal 3 and rapidly weakening the electric field. In this embodiment, a voltage of ±20 V is applied to the liquid crystal 3 in order to change the state of the liquid crystal to the focal conic state.

The liquid crystal molecules in the focal conic state are sequentially rotated in the in-plane direction of the electrode to form a spiral structure, and the spiral axis of the spiral structure is substantially parallel to the surface of the electrode. In the focal conic state, there is no selectivity of the wavelength of light reflected from the liquid crystal 3, and most of incident light passes through the liquid crystal. Since the light passing through the liquid crystal 3 is absorbed by the light absorbing layer 15 provided on the rear surface of the lower substrate 9 with high efficiency, dark (black) display is performed. Therefore, the liquid crystal display element 1 can perform display with a high contrast ratio.

A common driver 25 that has a driver IC for a scanning electrode mounted therein and outputs selection and non-selection signals to the plurality of scanning electrodes 17 is connected to the upper substrate 7 of the liquid crystal display panel 6. In addition, a segment driver 27 that has a data electrode driver IC mounted therein and outputs image data signals to the plurality of data electrodes 19 is connected to the lower substrate 9.

The common driver 25 sequentially shifts the i-th (first) to m-th (eighth) scanning electrodes 17 (i) one by one for selection on the basis of a frame start signal DIO output from a control unit 23. Then, the common driver 25 performs a so-called line sequential driving method that outputs the selection signals to the selected i-th scanning electrode 17(i) and outputs the non-selection signals to the other scanning electrodes 17.

The segment driver 27 outputs image data signals corresponding to the pixels 12(i, 1) to 12(i, n (=8)) on the selected i-th scanning electrode 17(i) to n data electrodes 19(j) (j is 1 to n), on the basis of a predetermined signal output from the control unit 23.

Figure 7:
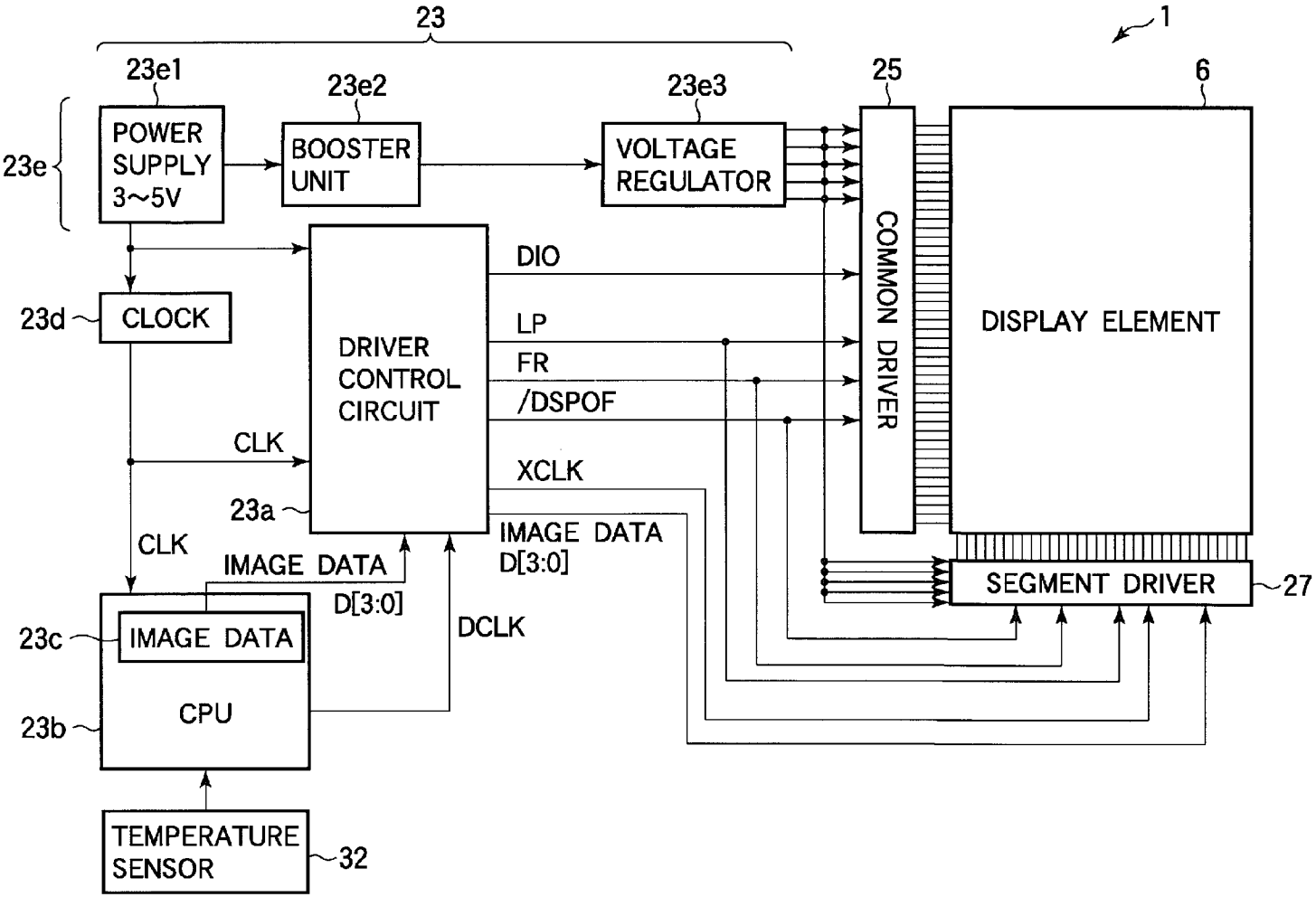
FIG. 7 is a diagram illustrating in more detail a control unit 23 of the liquid crystal display element according to the embodiment.

FIG. 7 shows the stricture of the liquid crystal display element 1, in which the control unit 23 is illustrated in more detail. As shown in FIG. 7, the control unit 23 includes a driver control circuit 23*a* that outputs various control signals and, for example, 4-bit image data D[3:0] (hereinafter, referred to as 'image data D') to the common driver 25 and the segment driver 27. In addition, the control unit 23 includes a central processing unit (CPU) 23*b* that outputs various control signals and the image data D to the driver control circuit 23*a*. Further, the control unit 23 includes a frame memory (image data storage unit) 23*c* that stores one frame of image data D that is input from an external system. Furthermore, the control unit 23 includes a clock circuit 23*d* that outputs a clock signal CLK for synchronization of various signal processing. Moreover, the control unit 23 includes a power supply unit 23*e* that supplies power to electronic circuits of the above-mentioned units.

When displaying an image on the liquid crystal display panel 6, the CPU 23*b* generates a data enable signal and a data clock signal DCLK on the basis of the clock signal CLK output from the clock circuit 23*d*. The CPU 23*b* transmits the data enable signal and the data clock signal DCLK to the driver control circuit 23*a*, and outputs the image data D stored in the frame memory 23*c* to the driver control circuit 23*a* in synchronization with the data clock signal DCLK. In addition, the CPU 23*b* and the frame memory 23*c* may be provided in an external system, separately from the liquid crystal display element 1.

The driver control circuit 23*a* transmits various control signals and the image data D to the common driver 25 and the segment driver 27, in synchronization with the data enable signal and the data clock signal DCLK input from the CPU 23*b*. Various control signals generated by the driver control circuit 23*a* include the frame start signal DIO, a latch pulse LP, a pulse polarity control signal FR, a driver output off signal /DSPOF (hereinafter, referred to as an 'off signal /DSPOF'), and a data read clock XCLK.

The frame start signal DIO is a start signal for instructing the start of writing of an image to the liquid crystal display panel 6, and is output to the common driver 25. The latch pulse LP, the pulse polarity control signal FR, and the off signal /DSPOF are output to both the common driver 25 and the segment driver 27.

The latch pulse LP is used to designate the scanning electrode 17(i) to be selected by a so-called line sequential driving method and simultaneously output rewriting images to a plurality of pixels 12(i, 1) to 12(i, n) on the selected scanning electrode 17(i).

The pulse polarity control signal FR is used to reverse the polarity of the voltage applied to the liquid crystal to apply an AC voltage, in order to prevent the deterioration of the liquid crystal due to the application of a DC voltage component. The driver control circuit 23*a* controls the pulse polarity control signal FR such that the polarity of the pulse waveform at the room temperature Hs is reversed in the middle of the selection period Td (a point of time Td/2 after the start of the period Td).

The off signal /DSPOF is used to forcibly set the level of the voltage applied to the liquid crystal to 0 V (GND) during the periods other than during the driving of the liquid crystal, in order to prevent a voltage from being applied when the liquid crystal is not driven. The off signal /DSPOF corresponds to the voltage cut off signal OS disclosed with reference to FIGS. 3 and 4 except that the off signal /DSPOF is a negative logic signal.

The CPU 23*b* instructs the driver control circuit 23*a* to perform a first mode that asserts the off signal /DSPOF during the time which includes the polarity reversal of the pulse waveform at the room temperature Hs as shown in FIG. 4 or a second mode that negates the off signal /DSPOF during the time which includes the polarity reversal of the pulse waveform at the room temperature Hs as shown in FIG. 3.

The data read clock XCLX and the image data D are output to the segment driver 27. The image data D is output in synchronization with the data read clock XCLK.

The power supply unit 23*e* converts a DC voltage of, for example, 3 to 5 V into a DC voltage required to drive the liquid crystal display panel 6. The power supply unit 23*e* includes a power supply 23*e*1 that supplies a DC voltage of 3 to 5 V. In addition, the power supply unit 23*e* includes a booster unit 23*e*2 provided with a DC-DC converter for boosting a voltage. Further, the power supply unit 23*e* includes a voltage regulator 23*e*3 provided with a Zener diode and an operational amplifier.

The booster unit 23*e*2 boosts a DC input voltage of 3 to 5 V of the power supply unit 23*e*1 to a voltage required for driving the liquid crystal display panel 6, for example, a voltage of about 30 to 40 V. The voltage regulator 23*e*3 uses the voltage boosted by the booster unit 23*e*2 and the input voltage to generate voltages having a plurality of levels that are required to drive the liquid crystal during the rewriting of an image or during the non-rewriting of an image. The voltage regulator 23*e*3 stabilizes the generated voltages and supplies the voltages to the common driver 25 and the segment driver 27 connected to the liquid crystal display panel 6.

A temperature sensor 32 using a thermistor or the like is connected to the CPU 23*b*. The temperature sensor 32 detects the external environmental temperature in a place where the liquid crystal display element 1 is provided. The CPU 23*b* determines whether the environmental temperature t is the high temperature Hh1 ($30<Hh1\leqq 40$) or the high temperature Hh2 ($40<Hh2$) on the basis of the temperature detected by the temperature sensor 32. When it is determined that the environmental temperature t is the high temperature Hh1, the CPU 23*b* instructs the driver control circuit 23*b* to set a pulse width ratio Pr=0.75. When it is determined that the environmental temperature t is the high temperature Hh2, the CPU 23*b* instructs the driver control circuit 23*b* to set a pulse width ratio Pr=0.5.

Figure 8:
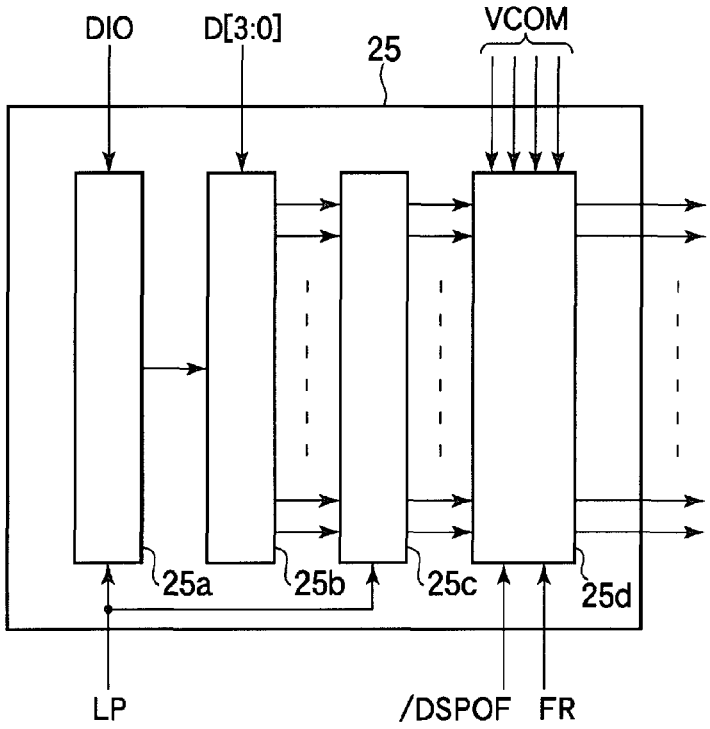
FIG. 8 is a diagram schematically illustrating the structure of a common driver 25 of the liquid crystal display element according to the embodiment.

FIG. 8 is a diagram schematically illustrating the structure of the common driver 25. The common driver 25 includes a shift register 25*a* that shifts a shift signal one bit by one bit and outputs the shift signal, whenever the latch pulse LP output from the driver control circuit 23*a* is input. In addition, the common driver 25 includes a data register 25*b* that sequentially stores data at predetermined addresses in response to the shift signals from the shift register 25*a*. In addition, a latch circuit 25*c* that latches data corresponding to one line, which is stored in the data register 25*b*, is provided in the next stage of the data register 25*b*. Further, the common driver 25 includes a liquid crystal driving circuit 25*d* that outputs a predetermined data voltage to each of the scanning electrodes 17.

The common driver 25 simultaneously outputs the same common-side reset data to all the scanning electrodes 17 during the reset process. Therefore, the data register 25*b* and the latch circuit 25*c* are provided between the shift register 25*a* and the liquid crystal driving circuit 25*d* such that the common driver serves similar to the segment driver.

During the display of an image, the common driver 25 directly inputs the shift signal of the shift register 25*a* to the liquid crystal driving circuit 25*d*, without operating the data register 25*b* and the latch circuit 25*c*. Then, the liquid crystal driving circuit 25*d* outputs the selection signal to a predetermined scanning electrode 17 in response to the shift signal, and outputs the non-selection signals to the other scanning electrodes 17.

The common driver 25 can switch the operation and non-operation of the data register 25*b* and the latch circuit 25*c* in response to instructions from the driver control circuit 23*a*.

A COM voltage (VCOM) output from the voltage regulator 23*e*3 of the control unit 23 is input to the liquid crystal driving circuit 25*d* of the common driver 25. The COM voltage includes +36 V, +20 V, +14 V, +6 V, and 0 V. The COM voltages of +20 V, +14 V, +6 V, and 0 V are used to display an image.

Table 1 shows the values of various voltages used to drive the liquid crystal during the display of an image. As shown in Table 1, the liquid crystal driving circuit 25*d* applies a COM voltage of +20 V to the selected scanning electrode 17 during a period before the middle Td/2 of the selection period Td, and applies a selection COM voltage of 0 V to the selected scanning electrode 17 during a period after the middle Td/2 of the selection period Td. The liquid crystal driving circuit 25*d* applies a non-selection COM voltage of +6 V to the non-selected scanning electrodes 17 during a period before the middle Tnd/2 of a non-selection period Tnd, and applies a non-selection COM voltage of +14 V to the non-selected scanning electrodes 17 during a period after the middle Tnd/2 of the non-selection period Tnd.

In addition, in this embodiment, the selection period Td, the non-selection period Tnd, and the pulse width Td of the voltage applied to the liquid crystal at the room temperature Hs are equal to each other.

TABLE 1

| During display of image | Before | After |
|---|---|---|
| Selection COM voltage | +20 | 0 |
| Non-selection COM voltage | +6 | +14 |
| SEG voltage for white display | +10 | +10 |
| SEG voltage for black display | 0 | +20 |
| Selection voltage applied (white) | +10 | −10 |
| Selection voltage applied (black) | +20 | −20 |
| Non-selection voltage applied (white) | −4 | +4 |
| Non-selection voltage applied (black) | +6 | −6 |

TABLE 2

| During reset | Before | After |
|---|---|---|
| Reset COM voltage | +36 | 0 |
| Reset SEG voltage | 0 | +36 |
| Voltage applied to liquid crystal during reset | +36 | −36 |

The COM voltages of +36 V and 0 V are used to reset an image. Table 2 shows the values of various voltages used to drive the liquid crystal during the reset process. As shown in Table 2, the liquid crystal driving circuit 25*d* applies a reset COM voltage of +36 V to all the scanning electrodes 17 during a period before the middle T/2 of a reset period T, and applies a reset COM voltage of 0 V to all the scanning electrodes 17 during a period after the middle T/2 of the reset period T during the reset process.

In addition to the latch pulse LP, the frame start signal DIO is input to the shift register 25*a*. In addition to the COM voltage, the pulse polarity control signal FR and the off signal /DSPOF are input to the liquid crystal driving circuit 25*d*.

Figure 9:
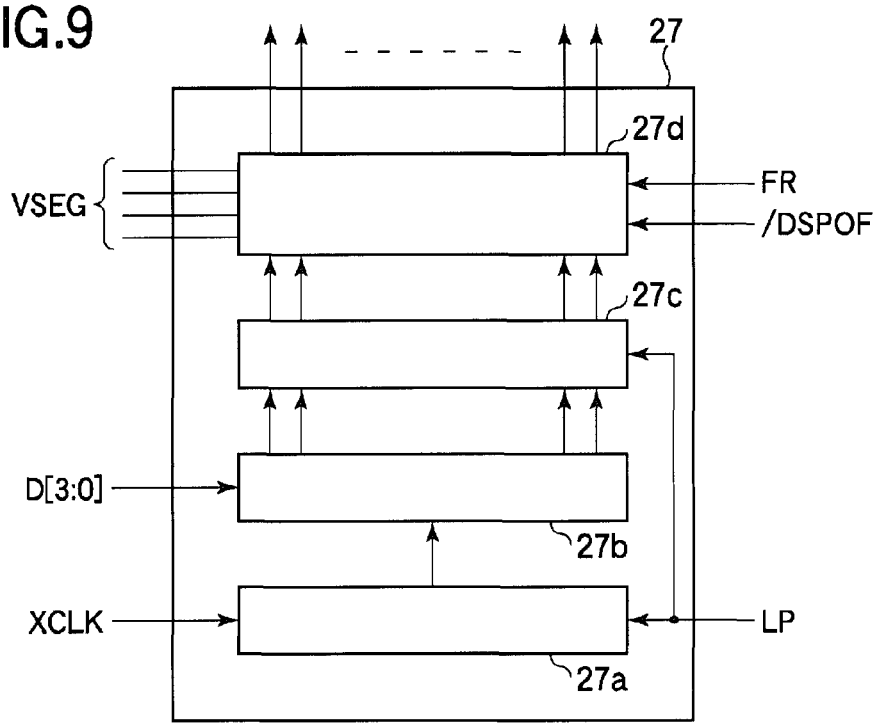
FIG. 9 is a diagram schematically illustrating the structure of a segment driver 27 of the liquid crystal display element according to the embodiment.

FIG. 9 is a diagram schematically illustrating the structure of the segment driver 27. The segment driver 27 includes a shift register 27*a* that shifts a shift signal one bit by one bit and outputs the shift signal, whenever the latch pulse LP output from the driver control circuit 23*a* is input. In addition, the segment driver 27 includes a data register 27*b* that sequentially stores the image data D at predetermined addresses in response to the shift signals from the shift register 27*a*. In addition, a latch circuit 27*c* that latches the image data D corresponding to one line, which is stored in the data register 27*b*, is provided in the next stage of the data register 27*b*. Further, the segment driver 27 includes a liquid crystal driving circuit 27*d* that outputs a predetermined data voltage to each of the data electrodes 19, on the basis of the image data D latched by the latch circuit 27*c*.

An SEG voltage (VSEG) output from the voltage regulator 23*e*3 of the control unit 23 is input to the liquid crystal driving circuit 27*d* of the segment driver 27. The SEG voltage includes +36 V, +20 V, +10 V, and 0 V. The SEG voltages of +20 V, +10 V, and 0 V are used to display an image. As shown in Table 1, an SEG voltage of +10 V is used to perform white display. The liquid crystal driving circuit 27*d* applies an SEG voltage for white display of +10 V to the data electrode 19 corresponding to the pixels for white display during the selection period Td. The liquid crystal driving circuit 27*d* applies an SEG voltage for black display of 0 V to the data electrode 19 corresponding to the pixels for black display during the period before the middle Td/2 of the selection period Td, and applies an SEG voltage for black display of +20 V to the data electrode 19 corresponding to the pixels for black display during the period after the middle Td/2 of the selection period Td.

The SEG voltages of +36 V and 0 V are used to reset an image. As shown in Table 2, the liquid crystal driving circuit 27*d* applies a reset SEG voltage of 0 V to all the data electrodes 19 during the period before the middle T/2 of the reset period T, and applies a reset SEG voltage of +36 V to all the data electrodes 19 during the period after the middle T/2 of the reset period T at the time of the reset process.

The latch pulse LP and the data read clock XCLK are input to the shift register 27*a*. In addition, the image data D is input to the data register 27*b*. The latch pulse LP is input to the latch circuit 27*c*. In addition to the SEG voltage, the pulse polarity control signal FR and the off signal /DSPOF are input to the liquid crystal driving circuit 27*d*.

Figure 10:
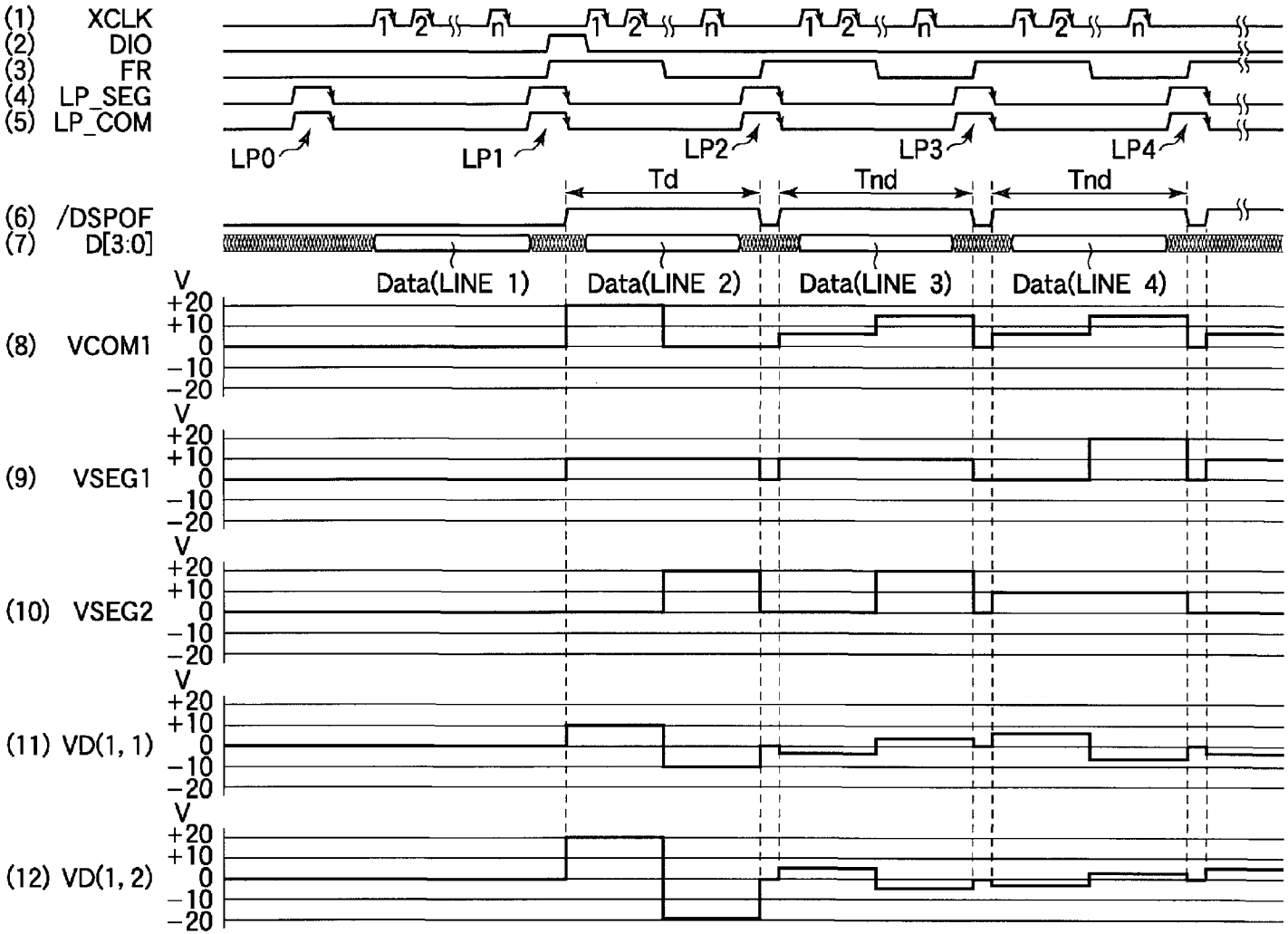
FIG. 10 is a diagram illustrating a method of driving the liquid crystal display element according to the embodiment during the display of images.
Figure 11:
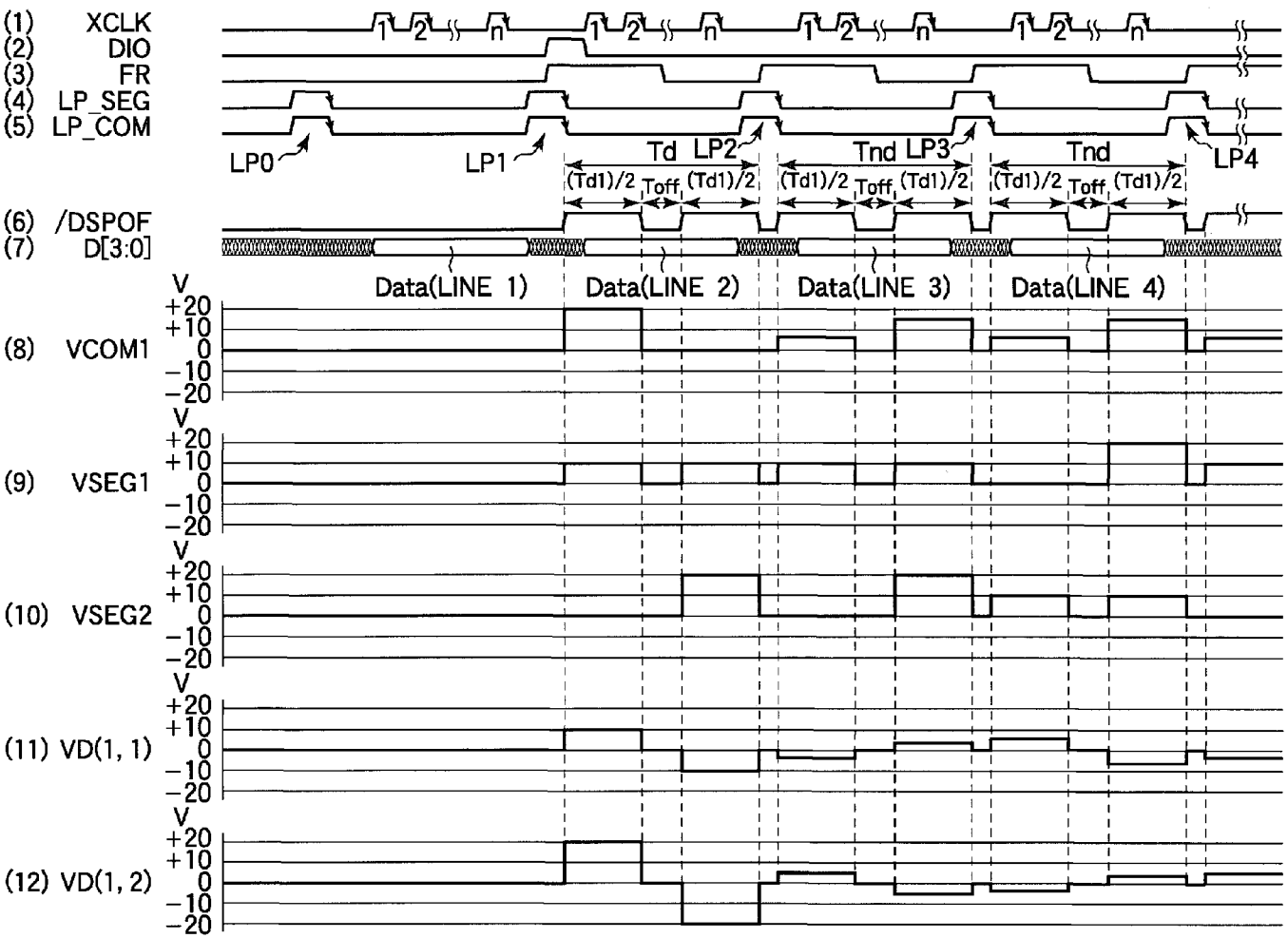
FIG. 11 is a diagram illustrating the method of driving the liquid crystal display element according to the embodiment during the display of images.
Figure 12:
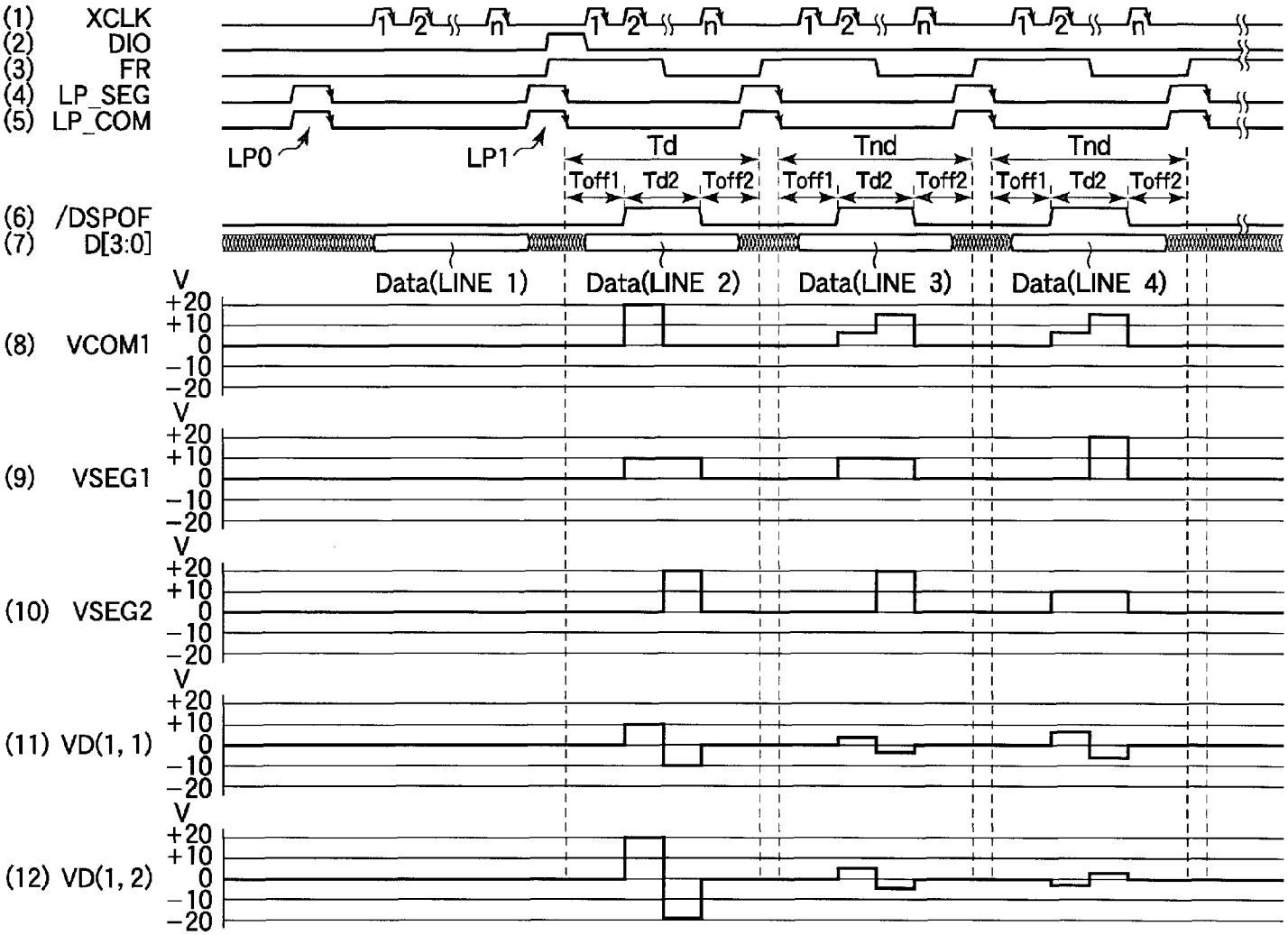
FIG. 12 is a diagram illustrating the method of driving the liquid crystal display element according to the embodiment during the display of images.

Next, a method of driving the liquid crystal display element to display an image according to this embodiment will be disclosed with reference to FIGS. 10 to 12. In this driving method, it is assumed that a reset process is executed beforehand to perform white display on the entire screen.

First, the driving method of the liquid crystal display element 1 when the environmental temperature t (° C.) is the room temperature Hs (25≦Hs≦30) will be disclosed with reference to FIG. 10. FIG. 10 shows the output timings of various signals output from the driver control circuit 23*a* and the waveforms of voltages applied to the liquid crystal.

From the upper side of FIG. 10, (1) shows the output timing of the data read clock XCLK that is output to the segment driver 27. (2) shows the output timing of the frame start signal DIO that is output to the common driver 25. (3) shows the output timing of the pulse polarity control signal FR that is output to both the common driver 25 and the segment driver 27. (4) shows the output timing of a latch pulse LP_SEG input to the segment driver 27, among the latch pulses LP that are output to both the common driver 25 and the segment driver 27. (5) shows the output timing of a latch pulse LP_COM input to the common driver 25, among the latch pulses LP that are output to both the common driver 25 and the segment driver 27. (6) shows the output timing of the off signal /DSPOF that is output to both the common driver 25 and the segment driver 27. (7) shows the output timing of the image data D that is output to the segment driver 27.

In (1) to (7) of FIG. 10, the horizontal axis indicates time (t), and the vertical axis indicates a signal level.

In FIG. 10, (8) shows the waveform of a COM voltage VCOM1 (V) that is output from the common driver 25 to, for example, the first scanning electrode 17(1) of one frame. (9) shows the waveform of an SEG voltage VSEG1 (V) that is output from the segment driver 27 to, for example, the first data electrode 19(1). (10) shows the waveform of an SEG voltage VSEG2(V) that is output from the segment driver 27 to, for example, the second data electrode 19(2). (11) shows the waveform of a voltage applied to the liquid crystal of a pixel 12(1, 1). In this embodiment, it is assumed that the pixel 12(1, 1) displays white. (12) shows the waveform of a voltage applied to the liquid crystal of a pixel 12(1, 2). In this embodiment, it is assumed that the pixel 12(1, 2) displays black.

In (8) to (12) of FIG. 10, the horizontal axis indicates time (t), and the vertical axis indicates a voltage level (V).

In FIG. 10, when the input of the image data D starts in synchronization with the data clock signal DCLK from the CPU 23*b*, the driver control circuit 23*a* outputs a latch pulse LP0 and outputs the data read clock signal XCLK to the segment driver 27. In addition, the driver control circuit 23*a* outputs n image data D to be written to a plurality of pixels 12(1, j) (1≦j≦n) on the first (line 1) scanning electrode 17(1) of the first frame as, for example, 4-bit parallel data in synchronization with the data read clock signal XCLK.

The shift register 27*a* of the segment driver 27 sequentially designates the storage addresses of the image data D that are sequentially input in the data register 27*b* in synchronization with, for example, the falling edge of the input data read clock signal XCLK. In this way, the n image data D written to the pixels 12(1, j) on the scanning electrode 17(1) are stored in the data register 27*b*.

Next, the driver control circuit 23*a* outputs the frame start signal DIO to the common driver 25 in synchronization with the first latch pulse LP1. In addition, the driver control circuit 23*a* asserts the pulse polarity control signal FR while the first latch pulse LP1 is asserted. In this embodiment, it is assumed that, when the pulse polarity control signal FR is in the asserted state, the pulse polarity of the voltage applied to the liquid crystal is positive, and when the pulse polarity control signal FR is in the negated state, the pulse polarity of the voltage applied to the liquid crystal is negative.

Further, the driver control circuit 23*a* negates the off signal /DSPOF in synchronization with, for example, the falling edge of the first latch pulse LP1. When the off signal /DSPOF is negated, the liquid crystal driving circuits 25*d* and 27*d* of the common and segment drivers 25 and 27 output the selected COM voltage and SEG voltage without any change, respectively. When the off signal /DSPOF is asserted, the liquid crystal driving circuits 25*d* and 27*d* output a voltage of 0 V (GND), instead of the selected COM voltage and SEG voltage.

When the frame start signal DIO is asserted, the shift register 25*a* of the common driver 25 outputs a shift signal for selecting the first scanning electrode 17(1) of the frame to the liquid crystal driving circuit 25*d* in synchronization with, for example, the falling edge of the first latch pulse LP1 input from the driver control circuit 23*a*.

Since the off signal /DSPOF is in the negated state, the liquid crystal driving circuit 25*d* applies the voltage VCOM1, which is a selection COM voltage of +20 V, to the first scanning electrode 17(1), and applies a non-selection COM voltage of +6 V to the other scanning electrodes 17(2 to m).

Meanwhile, the n image data D stored in the data register 27*b* of the segment driver 27 are latched by the latch circuit 27*c* in synchronization with, for example, the falling edge of the first latch pulse LP1. The latch circuit 27*c* simultaneously outputs the n image data D to the liquid crystal driving circuit 27*d*. The liquid crystal driving circuit 27*d* applies SEG voltages corresponding to the values of the n image data D to n data electrodes 19(1 to n) since the off signal /DSPOF is in the negated state. In this way, the image data D is written to a plurality of pixels 12(1, j) on the scanning electrode 17(1). An SEG voltage for white display of +10 V is applied as the voltage VSEG1 to the data electrode 19(1). An SEG voltage for black display of 0 V is applied as the voltage VSEG2 to the data electrode 19(2).

The driver control circuit 23*a* inverts the pulse polarity control signal FR to be the negated state at the end of the first half Td/2 of the selection period Td (=3.3 msec) that is equal to the pulse width Td at the room temperature Hs.

When the pulse polarity control signal FR is negated, the liquid crystal driving circuit 25*d* of the common driver 25 switches the selection COM voltage applied to the scanning electrode 17(1) from +20 V to 0 V. In addition, the liquid crystal driving circuit 25*d* switches the non-selection COM voltage applied to the other scanning electrodes 17(2 to m) from +6 V to +14 V.

In this way, a voltage VCOM1 of +20 V is applied to the scanning electrode 17(1) during the first half Td/2 of the selection period Td, and a voltage VCOM1 of 0 V is applied to the scanning electrode 17(1) during the second half Td/2 of the selection period Td. A voltage of +6 V is applied to the non-selected scanning electrodes 17 during the first half Tnd/2 of the non-selection period Tnd (=Td), and a voltage of +14 V is applied to the non-selected scanning electrodes 17 during the second half Tnd/2 of the non-selection period Tnd.

When the pulse polarity control signal FR is in the negated state, the liquid crystal driving circuit 27*d* of the segment driver 27 maintains the SEG voltage for white display at +10 V, and switches the SEG voltage for black display from 0 V to +20 V.

In this way, the voltage value of the data electrode 19 to which the SEG voltage for white display is applied becomes +10 V during the first half Td/2 and the second half Td/2 of the selection period Td. In addition, the voltage value of the data electrode 19 to which the SEG voltage for black display is applied becomes 0 V during the first half Td/2 of the selection period Td and becomes +20 V during the second half Td/2 thereof.

A driving voltage VD(1, 1) applied to the liquid crystal of the selected pixel 12(1, 1) on the selected scanning electrode 17(1) is +10 V (=the selection COM voltage−the SEG voltage for white display=+20 V−10 V) during the first half Td/2 of the selection period Td. In addition, the driving voltage VD(1, 1) is −10 V (=the selection COM voltage−the SEG voltage for white display=0 V−10 V) during the second half Td/2 of the selection period Td. That is, an AC pulse voltage VD(1, 1) of ±10 V is applied to the pixel 12(1, 1) during the selection period Td. Since the cholesteric liquid crystal according to this embodiment does not respond even when an AC voltage of ±10 V is applied thereto at the room temperature Hs during the selection period Td, white display during the reset process is maintained, and the pixel 12(1, 1) displays white.

Similarly, a driving voltage VD(1, 2) applied to the liquid crystal of the pixel 12(1, 2) is +20 V (=the selection COM voltage−the SEG voltage for black display=+20 V−0 V) during the first half Td/2 of the selection period Td. In addition, the driving voltage VD(1, 2) is −20 V (=the selection COM voltage−the SEG voltage for black display=0 V−20 V) during the second half Td/2 of the selection period Td. That is, an AC voltage VD(1, 2) of ±20 V is applied to the pixel 12(1, 2) during the selection period Td. When an AC voltage of ±20 V is applied to the cholesteric liquid crystal according to this embodiment at the room temperature Hs during the selection period Td, the state of the cholesteric liquid crystal is changed from a planar state to a focal conic state. Therefore, the pixel 12(1, 2) displays black.

When the selection period Td ends, the driver control circuit 23*a* asserts the pulse polarity control signal FR. In addition, when the selection period Td ends, the driver control circuit 23*a* asserts the off signal /DSPOF. In this way, instead of the COM voltage and the SEG voltage respectively selected by the liquid crystal driving circuits 25*d* and 27*d*, a voltage of 0 V (GND) is forcibly applied to the liquid crystal of the pixels 12 on all of the scanning electrodes 17 and the data electrodes 19.

In this way, the selection period Td (and the non-selection period Tnd) is defined during the period for which the off signal /DSPOF is in the negated state, and the asserted/negated states of the pulse polarity control signal FR are inverted at half the selection period Td, thereby reversing the polarity of the voltage applied and applying an AC voltage to the liquid crystal 3 of the pixels 12.

Next, the writing of image data to the pixels 12(2, j) on the second scanning electrode 17(2) of one frame will be disclosed. While image data is written to n pixels 12(1, 1) to 12(1, n) on the scanning electrode 17(1) by the above-mentioned method, the driver control circuit 23*a* outputs the first latch pulse LP1, and outputs the data read clock signal XCLK to the segment driver 27. In addition, the driver control circuit 23*a* outputs n image data to be written to a plurality of pixels 12(2, j) on the second (line 2) scanning electrode 17(2) from the head of the first frame as 4-bit parallel data, in synchronization with the data read clock signal XCLK.

The shift register 27*a* of the segment driver 27 sequentially designates the storage addresses of the image data D that are sequentially input in the data register 27*b* in synchronization with, for example, the falling edge of the input data read clock signal XCLK. In this way, the n image data D to be written to the pixels 12(2, j) on the scanning electrode 17(2) are stored in the data register 27*b*.

Then, the driver control circuit 23*a* negates the off signal /DSPOF in synchronization with, for example, the falling edge of the second latch pulse LP2.

The shift register 25*a* of the common driver 25 outputs a shift signal for selecting the second scanning electrode 17(2) from the head of the frame to the liquid crystal driving circuit 25*d* in synchronization with, for example, the falling edge of the second latch pulse LP2 input from the driver control circuit 23*a*.

Since the off signal /DSPOF is in the negated state, the liquid crystal driving circuit 25*d* applies a selection COM voltage of +20 V to the second scanning electrode 17(2), and applies a non-selection COM voltage of +6 V to the other scanning electrodes 17(1, 3 to m). Since the scanning electrode 17(1) is not selected, the voltage VCOM1, which is the non-selection COM voltage, is +6 V, as shown in (8) of FIG. 10.

Meanwhile, the n image data D stored in the data register 27*b* of the segment driver 27 are latched by the latch circuit 27*c* in synchronization with, for example, the falling edge of the second latch pulse LP2. The latch circuit 27*c* simultaneously outputs the n image data D to the liquid crystal driving circuit 27*d*. The liquid crystal driving circuit 27*d* applies SEG voltages corresponding to the values of the n image data D to n data electrodes 19(1 to n) since the off signal /DSPOF is in the negated state. In this way, the image data D is written to a plurality of pixels 12(2, j) on the scanning electrode 17(2). For example, an SEG voltage for white display of +10 V is applied as the voltage VSEG1 to the data electrode 19(1). For example, an SEG voltage for black display of 0 V is applied as the voltage VSEG2 to the data electrode 19(2).

The driver control circuit 23*a* inverts the pulse polarity control signal FR to be the negated state at the end of the first half Td/2 of the selection period Td of the scanning electrode 17(2).

When the pulse polarity control signal FR is negated, the liquid crystal driving circuit 25*d* of the common driver 25 switches the selection COM voltage applied to the scanning electrode 17(2) from +20 V to 0 V. In addition, the liquid crystal driving circuit 25*d* switches the non-selection COM voltage applied to the other scanning electrodes 17(1, 3 to m) from +6 V to +14 V. Therefore, as shown in (8) of FIG. 10, a voltage VCOM1 of +14 V is applied to the scanning electrode 17(1). In this way, a voltage of +20 V is applied to the scanning electrode 17(2) during the first half Td/2 of the selection period Td, and a voltage of 0 V is applied to the scanning electrode 17(2) during the second half Td/2 of the selection period Td. A voltage of +6 V is applied to the non-selected scanning electrodes 17 during the first half Tnd/2 of the non-selection period Tnd (=Td), and a voltage of +14 V is applied to the non-selected scanning electrodes 17 during the second half Tnd/2 of the non-selection period Tnd.

When the pulse polarity control signal FR is negated, the liquid crystal driving circuit 27*d* of the segment driver 27 maintains the SEG voltage for white display at +10 V, and switches the SEG voltage for black display from 0 V to +20 V. In this way, the voltage value of the data electrode 19 to which the SEG voltage for white display is applied becomes +10 V during the first half Td/2 and the second half Td/2 of the selection period Td. In addition, the voltage value of the data electrode 19 to which the SEG voltage for black display is applied becomes 0 V during the first half Td/2 of the selection period Td and becomes +20 V during the second half Td/2 thereof.

A driving voltage VD(1, 1) applied to the liquid crystal of the pixel 12(1, 1) on the non-selected scanning electrode 17(1) is −4 V (=the non-selection COM voltage−the SEG voltage for white display=+6 V−10 V) during the first half Tnd/2 of the non-selection period Tnd. In addition, the driving voltage VD(1, 1) is +4 V (=the non-selection COM voltage−the SEG voltage for white display=+14 V−10 V) during the second half Tnd/2 of the non-selection period Tnd. That is, an AC pulse voltage VD(1, 1) of +4 V is applied to the pixel 12(1, 1) during the non-selection period Tnd. Since the cholesteric liquid crystal according to this embodiment does not respond even when an AC voltage that is equal to or less than 10 V is applied thereto at the room temperature Hs during the non-selection period Tnd, the rewriting of an image to the pixel 12(1, 1) is not performed.

Similarly, a driving voltage VD(1, 2) applied to the liquid crystal of the non-selected pixel 12(1, 2) is +6 V (=the non-selection COM voltage−the SEG voltage for black display=+6 V−0 V) during the first half Tnd/2 of the non-selection period Tnd. In addition, the driving voltage VD(1, 2) is −6 V (=the non-selection COM voltage−the SEG voltage for black display=+14 V−20 V) during the second half Tnd/2 of the non-selection period Tnd. That is, an AC voltage VD(1, 2) of +6 V is applied to the pixel 12(1, 2) during the non-selection period Tnd. Therefore, the rewriting of an image to the pixel 12(1, 1) is not performed.

When the second half Td/2 of the selection period Td of the scanning electrode 17(2) ends, the driver control circuit 23*a* changes the pulse polarity control signal FR to the asserted state.

Further, when the selection period Td ends, the driver control circuit 23*a* changes the off signal /DSPOF to the asserted state. In this way, instead of the COM voltage and the SEG voltage respectively selected by the liquid crystal driving circuits 25*d* and 27*d*, a voltage of 0 V (GND) is forcibly applied to the liquid crystal of each of the pixels.

Then, the driver control circuit 23*a*, the common driver 25, and the segment driver 27 repeatedly perform the same operation as disclosed above from the third latch pulse LP3 to an m-th latch pulse LPm, thereby displaying one frame of image.

Next, a method of driving the liquid crystal display element 1 when the environmental temperature t (° C.) is the high temperature Hh1 (30<Hh1≦40) will be disclosed with reference to FIG. 11. FIG. 11 shows the output timings (1) to (7) of various signals output from the driver control circuit 23*a* and the waveforms (8) to (12) of the voltages applied to the liquid crystal, similar to FIG. 10. A description of the same matter as that in FIG. 10 will be omitted.

The driver control circuit 23*a* is instructed beforehand by the CPU 23*b* to set the pulse width ratio Pr to 0.75.

Further, the driver control circuit 23*a* is instructed beforehand by the CPU 23*b* to perform a first mode that asserts the off signal /DSPOF during the time including the polarity reversal of the pulse waveform at the room temperature Hs. Therefore, the driver control circuit 23*a* controls the off signal /DSPOF such that the voltage applied to the liquid crystal is forcibly turned off during the time including the time point of polarity switching of the pulse polarity control signal FR, which is set in the middle of the selection period Td (=3.3 msec) at the room temperature Hs.

A portion in the selection period Td for which the off signal /DSPOF is asserted is referred to as a cut off period Toff. When a pulse width Td1 is required for the high temperature Hh1 in the selection period Td, the cut off period Toff is Td−Td1=(1−0.75)×Td.

The period from the start of the assertion of the off signal /DSPOF to the time point when the polarity (state) of the pulse polarity control signal FR is switched, which is set in the middle of the selection period Td, is referred to as a cut off period Toff1, and the period from the time point when the polarity of the pulse polarity control signal FR is switched to the end of the assertion of the off signal /DSPOF is referred to as a cut off period Toff2.

The driver control circuit 23*a* controls the off signal /DSPOF such that Toff=Toff1+Toff2 and Toff1=Toff2=Toff/2 are satisfied, that is, the length of the cut off period Toff1 is equal to that of the cut off period Toff2.

In this way, even at the high temperature Hh1, the CPU 23*b* can output data to the driver control circuit 23*a* with a low load at the same transmission rate as that at which the image data D is transmitted at the room temperature Hs.

The driver control circuit 23*a* outputs the frame start signal DIO to the common driver 25 in synchronization with the first latch pulse LP1. In addition, the driver control circuit 23*a* asserts the pulse polarity control signal FR while the first latch pulse LP1 is in the asserted state.

Further, the driver control circuit 23*a* negates the off signal /DSPOF in synchronization with, for example, the falling edge of the first latch pulse LP1.

When the frame start signal DIO is asserted, the shift register 25*a* of the common driver 25 outputs a shift signal for selecting the first scanning electrode 17(1) of the head of the frame to the liquid crystal driving circuit 25*d* in synchronization with, for example, the falling edge of the first latch pulse LP1 input from the driver control circuit 23*a*.

Since the off signal /DSPOF is in the negated state, the liquid crystal driving circuit 25*d* applies the voltage VCOM1, which is a selection COM voltage of +20 V, to the first scanning electrode 17(1), and applies a non-selection COM voltage of +6 V to the other scanning electrodes 17(2 to m).

Meanwhile, the liquid crystal driving circuit 27*d* of the segment driver 27 applies SEG voltages corresponding to the values of n image data D to n data electrodes 19(1 to n) since the off signal /DSPOF is in the negated state. In this way, the image data D is written to a plurality of pixels 12(1, j) on the scanning electrode 17(1). An SEG voltage for white display of +10 V is applied as the voltage VSEG1 to the data electrode 19(1). An SEG voltage for black display of 0 V is applied as the voltage VSEG2 to the data electrode 19(2).

Then, after the front period (Td1)/2=(0.375)×Td of the selection period Td has elapsed, the driver control circuit 23*a* asserts the off signal /DSPOF. In this way, the cut off period Toff starts, and instead of the COM voltage, a voltage of 0 V (GND) is forcibly output from the liquid crystal driving circuit 25*d*.

Then, when the time reaches the end of cut off period Toff1, the driver control circuit 23*a* inverts the pulse polarity control signal FR to be the negated state. Since the off signal /DSPOF is in the asserted state, the output voltage of the liquid crystal driving circuits 25*d* and 27*d* is maintained at 0 V (GND).

Then, when the cut off period Toff2 has elapsed after the pulse polarity control signal FR was inverted, that is, when the asserted state of the off signal /DSPOF is maintained during the cut off period Toff=(0.250)×Td after the front selection period (Td1)/2 has elapsed, the driver control circuit 23*a* changes the off signal /DSPOF to the negated state, and maintains the negated state during the period (Td1)/2=(0.375)×Td.

When the pulse polarity control signal FR is negated, the liquid crystal driving circuit 25*d* of the common driver 25 switches the selection COM voltage applied to the scanning electrode 17(1) from +20 V to 0 V. In addition, the liquid crystal driving circuit 25*d* switches the non-selection COM voltage applied to the other scanning electrodes 17(2 to m) from +6 V to +14 V.

In this way, a voltage VCOM1 of +20 V is applied to the scanning electrode 17(1) during the front period (Td1)/2 of the selection period Td, and a voltage VCOM1 of 0 V is applied to the scanning electrode 17(1) during the rear period (Td1)/2 of the selection period Td. The voltage VCOM1 applied to the scanning electrode 17(1) during the cut off period Toff between the front and rear periods of the selection period Td is forcibly set to 0 V.

A non-selection COM voltage of +6 V is applied to the non-selected scanning electrodes 17 during the front period (Td1)/2 of the non-selection period Tnd (=Td), and a non-selection COM voltage of +14 V is applied to the non-selected scanning electrodes during the rear period (Td1)/2 thereof. The voltage applied to the non-selected scanning electrodes 17 during the cut off period Toff between the front and rear periods of the non-selection period Tnd is forcibly set to 0 V.

Furthermore, when the pulse polarity control signal FR is in the negated state, the liquid crystal driving circuit 27*d* of the segment driver 27 maintains the SEG voltage for white display at +10 V, and switches the SEG voltage for black display from 0 V to +20 V.

In this way, the voltage value of the data electrode 19(1) to which the SEG voltage for white display is applied is a voltage VSEG1 of +10 V during the front period (Td1)/2 and the rear period (Td1)/2 of the selection period Td. In addition, the voltage VSEG1 is forcibly set to 0 V during the cut off period Toff between the front and rear periods of the selection period Td.

Further, the voltage value of the data electrode 19(2) to which the SEG voltage for black display is applied is a voltage VSEG2 of 0 V during the front period (Td1)/2 of the selection period Td, and is a voltage VSEG2 of +20 V during the rear period (Td1)/2 of the selection period Td. In addition, the voltage VSEG2 is forcibly set to 0 V during the cut off period Toff between the front period and the rear period of the selection period Td.

A driving voltage VD(1, 1) applied to the liquid crystal of the selected pixel 12(1, 1) on the selected scanning electrode 17(1) is +10 V (=the selection COM voltage−the SEG voltage for white display=+20 V−10 V) during the front period (Td1)/2 of the selection period Td. In addition, the driving voltage VD(1, 1) is −10 V (=the selection COM voltage−the SEG voltage for white display=0 V−10 V) during the rear period (Td1)/2 of the selection period Td. The voltage VD(1, 1) is forcibly set to 0 V during the cut off period Toff between the front period and the rear period of the selection period Td.

That is, an AC voltage VD(1, 1) of ±10 V is applied to the pixel 12(1, 1) with a pulse width Td1=(0.75)×Td at the high temperature Hh1 during the selection period Td that is equal to the pulse width at the room temperature Hs. Since the cholesteric liquid crystal according to this embodiment does not respond even when a voltage of ±10 V is applied with the pulse width Td1 at the high temperature Hh1, white display is maintained during the reset process, and the pixel 12(1, 1) displays white.

Similarly, a driving voltage VD(1, 2) applied to the liquid crystal of the selected pixel 12(1, 2) is +20 V (=the selection COM voltage−the SEG voltage for black display=+20 V−0 V) during the front period (Td1)/2 of the selection period Td. In addition, the driving voltage VD(1, 2) is −20 V (=the selection COM voltage−the SEG voltage for black display=0 V−20 V) during the rear period (Td1)/2 of the selection period Td. The voltage VD(1, 2) is forcibly set to 0 V during the cut off period Toff between the front period and the rear period of the selection period Td.

That is, an AC voltage VD(1, 2) of ±20 V is applied to the pixel 12(1, 2) with a pulse width Td1=(0.75)×Td at the high temperature Hh1 during the selection period Td. The cholesteric liquid crystal according to this embodiment is changed from a planar state to a focal conic state when a voltage of +20 V is applied with the pulse width Td1 at the high temperature Hh1. Therefore, the pixel 12(1, 2) displays black.

In this way, it is possible to use the off signal /DSPOF to set the cut off period Toff which includes the time point of the polarity switching of the pulse polarity control signal FR within the selection period Td that is equal to the pulse width Td at the room temperature Hs. Therefore, it is possible to apply to the liquid crystal an AC driving voltage with a short pulse width Td1 (=(0.75)×Td) for the high temperature Hh1 during the same selection period Td as that at the room temperature Hs.

When the selection period Td ends, the driver control circuit 23*a* asserts the pulse polarity control signal FR.

In addition, when the selection period Td ends, the driver control circuit 23*a* asserts the off signal /DSPOF. In this way, instead of the COM voltage and the SEG voltage respectively selected by the liquid crystal driving circuits 25*d* and 27*d*, a voltage of 0 V (GND) is forcibly applied to all of the scanning electrodes 17 and the data electrodes 19.

Then, the driver control circuit 23*a*, the common driver 25, and the segment driver 27 repeatedly perform the same operation as disclosed above from the second latch pulse LP2 to an m-th latch pulse LPm, thereby displaying one frame of image.

Next, a method of driving the liquid crystal display element 1 when the environmental temperature t (° C.) is the high temperature Hh2 (40<Hh2) will be disclosed with reference to FIG. 12. FIG. 12 shows the output timings (1) to (7) of various signals output from the driver control circuit 23*a* and the waveforms (8) to (12) of the voltages applied to the liquid crystal, similar to FIGS. 10 and 11. A description of the same matter as that in FIGS. 10 and 11 will be omitted.

The driver control circuit 23*a* is instructed beforehand by the CPU 23*b* to set the pulse width ratio Pr to 0.5.

Further, the driver control circuit 23*a* is instructed beforehand by the CPU 23*b* to perform the second mode that negates the off signal /DSPOF during the time including the time point of the polarity reversal of the pulse waveform at the room temperature Hs. Therefore, the driver control circuit 23*a* controls the off signal /DSPOF such that a voltage to be applied to the liquid crystal is output during the time including the time point of the polarity switching of the pulse polarity control signal FR, which is set in the middle of the selection period Td (=3.3 msec) at the room temperature Hs. That is, the driver control circuit 23*a* controls the off signal /DSPOF such that the voltage applied to the liquid crystal is forcibly turned off at both sides of the period in which the polarity of the pulse polarity control signal FR is switched, which is set in the middle of the selection period Td at the room temperature Hs.

When a portion of the selection period Td for which the off signal /DSPOF is asserted is referred to as a cut off period Toff and a pulse width Td2 is required for the high temperature Hh2 in the selection period Td, the cut off period Toff is Td−Td2=(1−0.5)×Td.

The cut off period Toff includes a cut off period Toff1 and a cut off period Toff2 that are set separately at both sides of the period for which the polarity of the pulse polarity control signal FR is switched.

The driver control circuit 23*a* controls the off signal /DSPOF such that Toff=Toff1+Toff2 and Toff1=Toff2=Toff/2 are satisfied, that is, the length of the cut off period Toff1 is equal to that of the cut off period Toff2.

In this way, even at the high temperature Hh2, the CPU 23*b* can output data to the driver control circuit 23*a* with a low load at the same transmission rate as that at which the image data D is transmitted at the room temperature Hs.

The driver control circuit 23*a* outputs the frame start signal DIO to the common driver 25 in synchronization with the first latch pulse LP1. In addition, the driver control circuit 23*a* asserts the pulse polarity control signal FR while the first latch pulse LP1 is in the asserted state.

Further, the driver control circuit 23*a* asserts the off signal /DSPOF at least until the first latch pulse LP1 is output.

When the off signal /DSPOF is maintained in the asserted state during the cut off period Toff1=(0.25)×Td on the basis of the falling edge of the first latch pulse LP1, the driver control circuit 23*a* switches the off signal /DSPOF to the negated state, and maintains the negated state during the selection period Td2=(0.5)×Td.

When the frame start signal DIO is asserted, the shift register 25*a* of the common driver 25 outputs a shift signal for selecting the first scanning electrode 17(1) of the frame to the liquid crystal driving circuit 25*d* in synchronization with, for example, the falling edge of the first latch pulse LP1 input from the driver control circuit 23*a*.

However, since the off signal /DSPOF is in the asserted state, instead of the COM voltage, a voltage of 0 V (GND) is forcibly output from the liquid crystal driving circuit 25*d*.

Similarly, since the off signal /DSPOF is in the asserted state, instead of the SEG voltage, a voltage of 0 V (GND) is forcibly output from the liquid crystal driving circuit 27*d* of the segment driver 27.

Then, the driver control circuit 23*a* negates the off signal /DSPOF immediately after the cut off period Toff1 has elapsed. In this way, the liquid crystal driving circuit 25*d* of the common driver 25 applies the voltage VCOM1, which is a selection COM voltage of +20 V, to the first scanning electrode 17(1) of the frame, and applies a non-selection COM voltage of +6 V to the other scanning electrodes 17(2 to m).

Meanwhile, the liquid crystal driving circuit 27*d* of the segment driver 27 applies SEG voltages corresponding to the values of n image data D to n data electrodes 19(1 to n) since the off signal /DSPOF is in the negated state. In this way, the image data D is written to a plurality of pixels 12(1, j) on the scanning electrode 17(1). An SEG voltage for white display of +10 V is applied as the voltage VSEG1 to the data electrode 19(1). An SEG voltage for black display of 0 V is applied as the voltage VSEG2 to the data electrode 19(2).

Then, the driver control circuit 23*a* inverts the pulse polarity control signal FR to be the negated state at the end of the first half Td/2 of the selection period Td of the scanning electrode 17(1).

The off signal /DSPOF is maintained in the negated state. Therefore, when the pulse polarity control signal FR is negated, the liquid crystal driving circuit 25*d* of the common driver 25 switches the selection COM voltage applied to the scanning electrode 17(1) from +20 V to 0 V. In addition, the liquid crystal driving circuit 25*d* switches the non-selection COM voltage applied to the other scanning electrodes 17(2 to m) from +6 V to +14 V.

After the off signal /DSPOF is maintained in the negated state during the period Td2, the driver control circuit 23*a* switches the off signal /DSPOF to the asserted state, and maintains the state at least during the cut off period Toff2=(0.25)×Td.

In this way, a voltage VCOM1 of +20 V is applied to the scanning electrode 17(1) during the first half of the period Td2 of the selection period Td, and a voltage VCOM1 of 0 V is applied to the scanning electrode 17(1) during the second half of the period Td2. A voltage VCOM1 of 0 V is forcibly applied to the scanning electrode 17(1) during the front and rear cut off periods Toff1 and Toff2 of the selection period Td.

A non-selection COM voltage of +6 V is applied to the non-selected scanning electrodes 17 during the first half of the period Td2 of the non-selection period Tnd, and a non-selection COM voltage of +14 V is applied to the non-selected scanning electrodes 17 during the second half of the period Td2. A voltage VCOM1 of 0 V is forcibly applied to the non-selected scanning electrodes 17 during the front and rear cut off periods Toff1 and Toff2 of the non-selection period Tnd.

When the pulse polarity control signal FR is negated, the liquid crystal driving circuit 27*d* of the segment driver 27 maintains the SEG voltage for white display at +10 V, and switches the SEG voltage for black display from 0 V to +20 V.

In this way, the voltage value of the data electrode 19(1) to which the SEG voltage for white display is applied becomes a voltage VSEG1 of +10 V during the first half and the second half of the period Td2. A voltage VSEG1 of 0 V is forcibly applied during the front and rear cut off periods Toff1 and Toff2 of the selection period Td.

In addition, the voltage value of the data electrode 19(2) to which the SEG voltage for black display is applied becomes a voltage VSEG2 of 0 V during the first half of the period Td2 and becomes a voltage VSEG2 of +20 V during the second half thereof. A voltage VSEG2 of 0 V is forcibly applied during the front and rear cut off periods Toff1 and Toff2 of the selection period Td.

A driving voltage VD(1, 1) applied to the liquid crystal of the pixel 12(1, 1) on the selected scanning electrode 17(1) is +10 V (=the selection COM voltage−the SEG voltage for white display=+20 V−10 V) during the first half of the period Td2. In addition, the driving voltage VD(1, 1) is −10 V (=the selection COM voltage−the SEG voltage for white display =0 V−10 V) during the second half of the period Td2. A voltage VD(1, 1) of 0 V is forcibly applied during the front and rear cut off periods Toff1 and Toff2 of the selection period Td.

That is, an AC voltage VD(1, 1) of ±10 V is applied to the pixel 12(1, 1) with a pulse width Td2=(0.5)×Td at the high temperature Hh2 during the selection period Td that is equal to the pulse width at the room temperature Hs. Since the cholesteric liquid crystal according to this embodiment does not respond even when a voltage of ±10 V is applied with the pulse width Td2 at the high temperature Hh2, white display is maintained during the reset process, and the pixel 12(1, 1) displays white.

Similarly, a driving voltage VD(1, 2) applied to the liquid crystal of the selected pixel 12(1, 2) is +20 V (=the selection COM voltage−the SEG voltage for black display=+20 V−0 V) during the first half of the period Td2. In addition, the driving voltage VD(1, 2) is −20 V (=the selection COM voltage−the SEG voltage for black display=0 V−20 V) during the second half of the period Td2. A voltage VD(1, 2) of 0 V is forcibly applied during the front and rear cut off periods Toff1 and Toff2 of the selection period Td.

That is, an AC voltage VD(1, 2) of ±20 V is applied to the pixel 12(1, 2) with a pulse width Td2=(0.5)×Td at the high temperature Hh2 during the selection period Td. When a voltage of ±20 V is applied to the cholesteric liquid crystal according to this embodiment with the pulse width Td2 at the high temperature Hh2, the state of the cholesteric liquid crystal is changed from a planar state to a focal conic state. Therefore, the pixel 12(1, 2) displays black.

In this way, it is possible to use the off signal /DSPOF to set the cut off periods Toff at both sides of the period which includes the time point of the polarity switching of the pulse polarity control signal FR within the selection period Td that is equal to the pulse width Td at the room temperature Hs. Therefore, it is possible to apply to the liquid crystal an AC driving voltage with a short pulse width Td2(=(0.5)×Td) for the high temperature Hh2 during the same selection period Td as that at the room temperature Hs.

When the selection period Td ends, the driver control circuit 23*a* asserts the pulse polarity control signal FR.

In addition, even after the selection period Td ends, the driver control circuit 23*a* maintains the off signal /DSPOF in the asserted state. In this way, instead of the COM voltage and the SEG voltage respectively selected by the liquid crystal driving circuits 25*d* and 27*d*, a voltage of 0 V (GND) is forcibly applied to all of the scanning electrodes 17 and the data electrodes 19.

Then, the driver control circuit 23*a*, the common driver 25, and the segment driver 27 repeatedly perform the same operation as disclosed above from the second latch pulse LP2 to an m-th latch pulse LPm, thereby displaying one frame of image.

Figure 13:
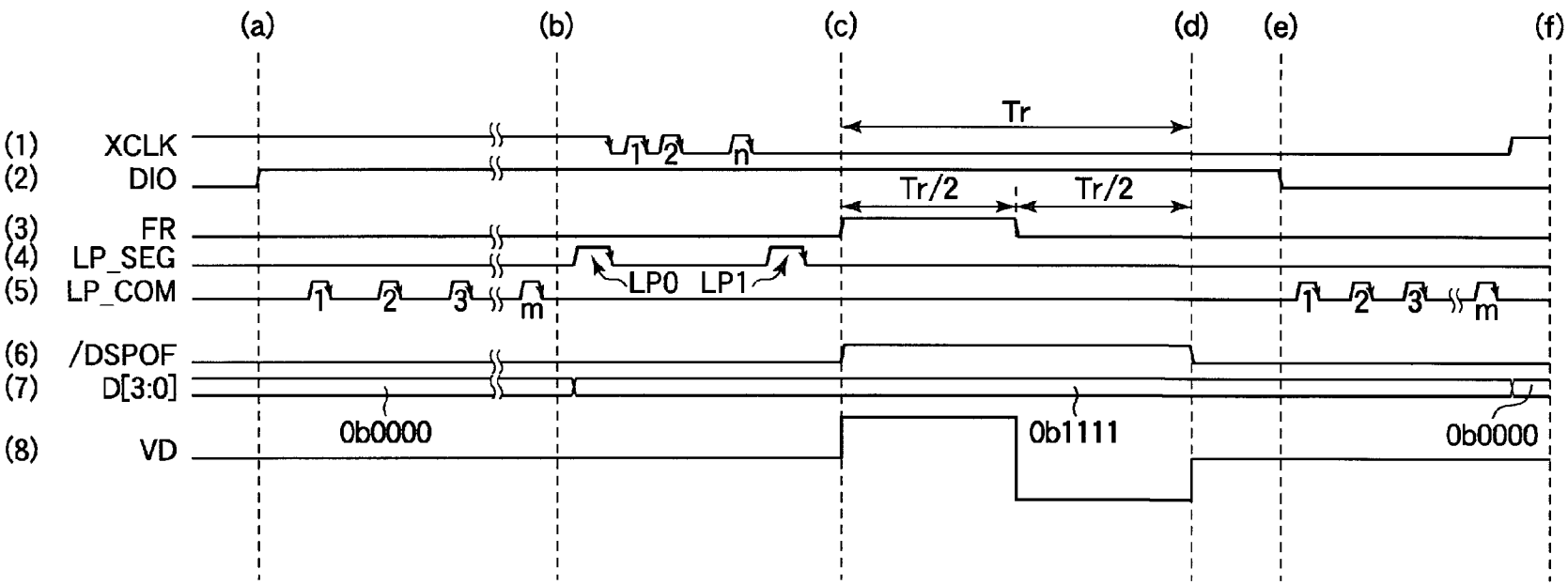
FIG. 13 is a diagram illustrating a method of driving the liquid crystal display element according to the embodiment during a reset process.
Figure 14:
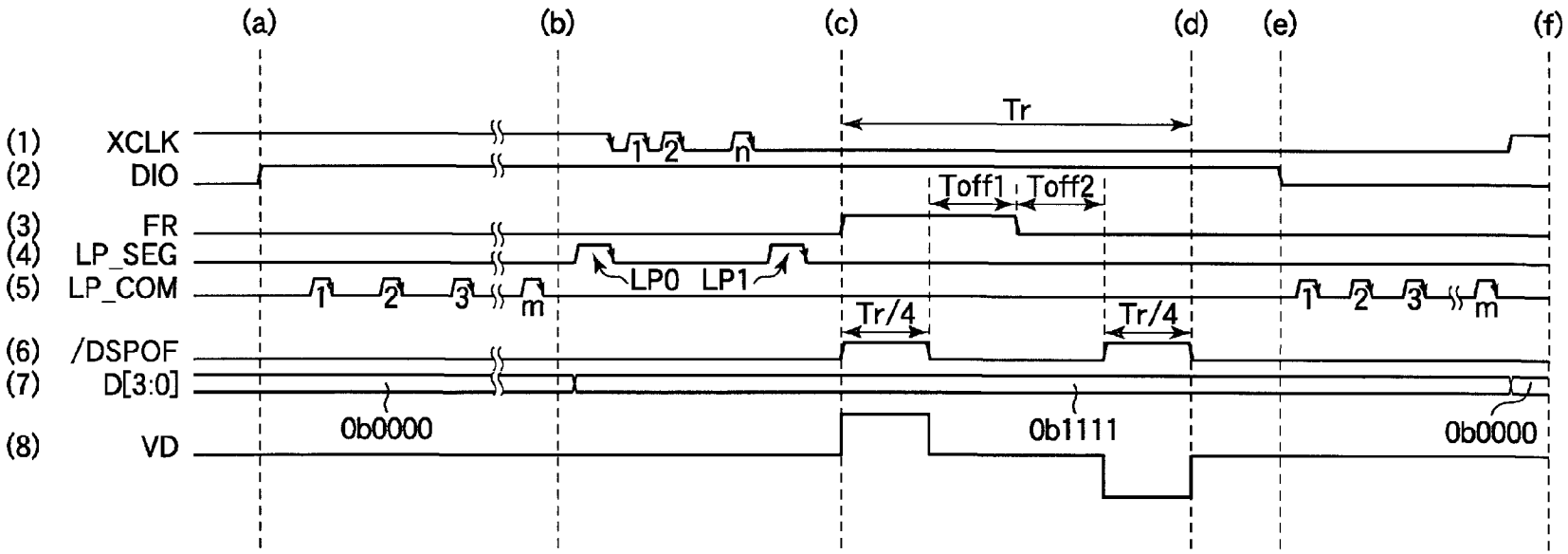
FIG. 14 is a diagram illustrating the method of driving the liquid crystal display element according to the embodiment during the reset process.
Figure 15:
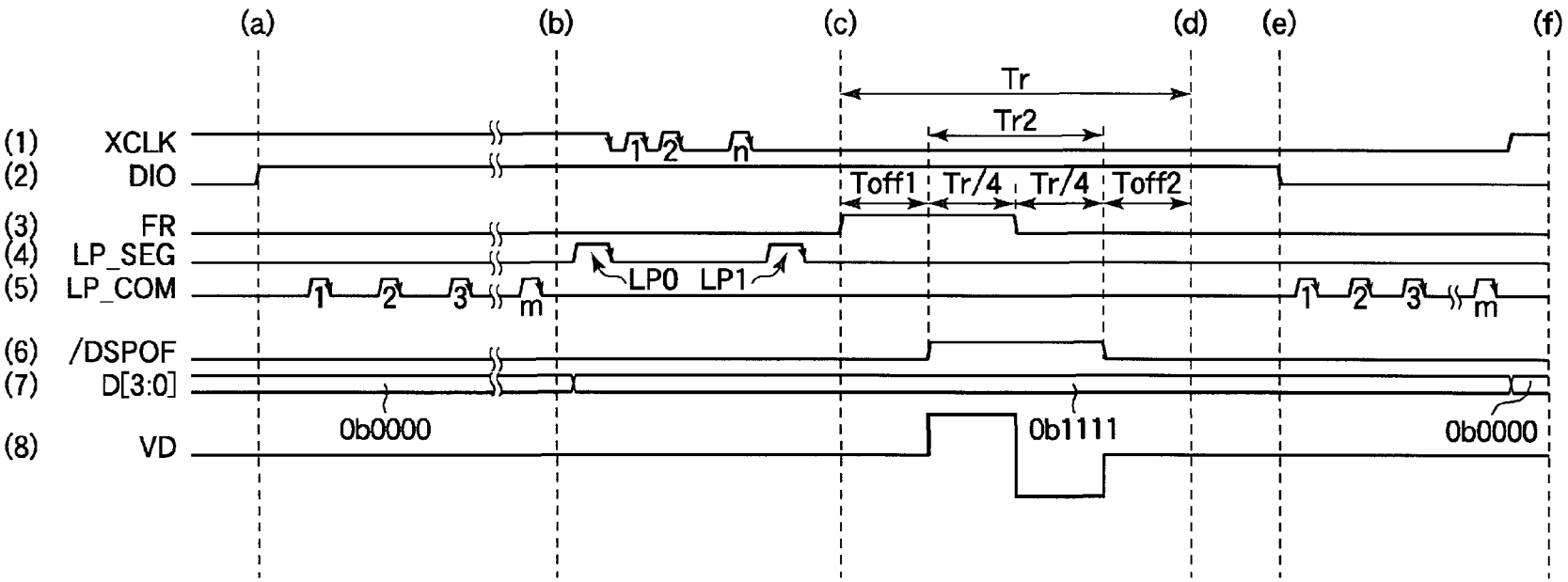
FIG. 15 is a diagram illustrating the method of driving the liquid crystal display element according to the embodiment during the reset process.

Next, the reset process of the liquid crystal display element 1 according to this embodiment will be disclosed with reference to FIGS. 13 to 15.

First, the reset process of the liquid crystal display element 1 when the environmental temperature t (° C.) is the room temperature Hs (25≦Hs≦30) will be disclosed with reference to FIG. 13. FIG. 13 shows the output timings (1) to (7) of various signals output from the driver control circuit 23*a*, similar to FIG. 10. A description of the same matter as that in FIG. 10 will be omitted. In FIG. 13, (8) shows the waveform of a driving voltage VD that is applied to the liquid crystal 3 of all of the pixels 12(1, 1) to 12(m, n) under the same condition by the reset process. In (8) of FIG. 13, the horizontal axis indicates time (t) and the vertical axis indicates a voltage level (V).

Further, in FIG. 13, time point (a) shows the start of the selection of all the scanning electrodes 17. Time point (b)

shows the start of the selection of all the data electrodes 19. Time point (c) shows the start of a reset period Tr, and time point (d) shows the end of the reset period Tr. Further, time point (e) shows the end of the selection of all the scanning electrodes 17, and time point (f) shows the end of the reset process performed on all the pixels.

When receiving an instruction to start the reset process from the CPU 23*b*, the driver control circuit 23*a* switches the setting of the common driver 25 to the reset process, and asserts the frame start signal DIO, as shown in the time point (a) of FIG. 13.

Then, the driver control circuit 23*a* sequentially transmits m latch pulses LP (latch pulses LP_COM) to the shift register 25*a* of the common driver 25. In addition, the driver control circuit 23*a* outputs m scanning electrode reset data Dc (="0b0000") having the same value, which will be applied to all the scanning electrodes 17(1 to m), that is, the first (line 1) to last (line m) scanning electrodes 17 of the frame, as 4-bit parallel data in synchronization with the latch pulses LP_COM.

The shift register 25*a* of the common driver 25 sequentially designates the storage addresses of the scanning electrode reset data Dc that are sequentially input in the data register 25*b* in synchronization with, for example, the falling edge of the input latch pulse LP_COM. In this way, the m scanning electrode reset data Dc having the same value, which will be written to all the scanning electrodes 17, are stored in the data register 25*b*.

Then, when the input of data electrode reset data Dd starts in synchronization with the data clock signal DCLK from the CPU 23*b* after the time point (b) shown in FIG. 13 has elapsed, the driver control circuit 23*a* outputs a latch pulse LP0 (latch pulse LP-SEG), and outputs the data read clock signal XCLK to the segment driver 27. Further, the driver control circuit 23*a* outputs n data electrode reset data Dd (="0b1111") having the same value, which will be applied to n data electrodes 19 (1 to n), as 4-bit parallel data in synchronization with the data read clock signal XCLK.

The shift register 27*a* of the segment driver 27 sequentially designates the storage addresses of the data electrode reset data Dd that are sequentially input in the data register 27*b* in synchronization with, for example, the falling edge of the input data read clock signal XCLK. In this way, the n data electrode reset data Dd having the same value, which will be written to all the data electrodes 19, are stored in the data register 27*b*.

Then, the driver control circuit 23*a* asserts the pulse polarity control signal FR at the time point (c) after the first latch pulse LP1 is output. In this embodiment, it is assumed that, when the pulse polarity control signal FR is in the asserted state, the pulse polarity of the voltage applied to the liquid crystal is positive, and when the pulse polarity control signal FR is in the negated state, the pulse polarity is negative.

The driver control circuit 23*a* negates the off signal /DSPOF at the same time as asserting the pulse polarity control signal FR. In this way, at the time point (c), the reset period Tr starts.

When the off signal /DSPOF is negated, the liquid crystal driving circuits 25*d* and 27*d* of the drivers 25 and 27 output the selected COM voltage and SEG voltage without any change. When the off signal /DSPOF is asserted, the liquid crystal driving circuits 25*d* and 27*d* output a voltage of 0 V (GND), instead of the selected COM voltage and SEG voltage.

The m scanning electrode reset data Dc stored in the data register 25*b* of the common driver 25 are latched by the latch circuit 25*c* in synchronization with, for example, the falling edge of the first latch pulse LP1. The latch circuit 25*c* simultaneously outputs the m scanning electrode reset data Dc to the liquid crystal driving circuit 25*d*. When the off signal /DSPOF is negated, the liquid crystal driving circuit 25*d* applies reset COM voltages corresponding to the m scanning electrode reset data Dc to m scanning electrodes 17(1 to m). A voltage of +36 V is applied to all the scanning electrodes 17 as the reset COM voltage.

Meanwhile, the n data electrode reset data Dd stored in the data register 27*b* of the segment driver 27 are latched by the latch circuit 27*c* in synchronization with, for example, the falling edge of the first latch pulse LP1. The latch circuit 27*c* simultaneously outputs the n data electrode reset data Dd to the liquid crystal driving circuit 27*d*. When the off signal /DSPOF is negated, the liquid crystal driving circuit 27*d* applies reset SEG voltages corresponding to the n data electrode reset data Dd to n data electrodes 19(1 to n). A voltage of 0 V is applied to all the data electrodes 19 as the reset SEG voltage.

The driver control circuit 23*a* inverts the pulse polarity control signal FR to be the negated state at the end point of the first half Tr/2 of the reset period Tr (=60 msec) that is equal to a reset pulse width Tr at the room temperature Hs.

When the pulse polarity control signal FR is negated, the liquid crystal driving circuit 25*d* of the common driver 25 switches the reset COM voltage applied to all the scanning electrodes 17 from +36 V to 0 V. In this way, a reset COM voltage of +36 V is applied to all the scanning electrodes 17 during the first half Tr/2 of the reset period Tr, and a reset COM voltage of 0 V is applied to all the scanning electrodes 17 during the second half Tr/2.

When the pulse polarity control signal FR is negated, the liquid crystal driving circuit 27*d* of the segment driver 27 switches the reset SEG voltage applied to all the data electrodes 19 from 0 V to +36 V. In this way, a reset SEG voltage of 0 V is applied to all the data electrodes 19 during the first half Tr/2 of the reset period Tr, and a reset SEG voltage of +36 V is applied to all the data electrodes 19 during the second half Tr/2.

Therefore, the driving voltage VD applied to the liquid crystal 3 of all the pixels 12(1, 1) to 12(m, n) is +36 V (=the reset COM voltage−the reset SEG voltage=+36 V−0 V) during the first half Tr/2 of the reset period Tr. In addition, the driving voltage VD is −36 V (=the reset COM voltage−the reset SEG voltage=0 V-36 V) during the second half Tr/2 of the reset period Tr. That is, an AC pulse voltage VD of ±36 V is applied to all the pixels 12(1, 1) to 12(m, n) during the reset period Tr. When an AC voltage of ±36 V is applied to the cholesteric liquid crystal according to this embodiment during the reset period Tr at the room temperature Hs, the cholesteric liquid crystal changes to a homeotropic state.

As shown in the time point (d), when the reset period Tr ends, the driver control circuit 23*a* asserts the off signal /DSPOF. In this way, instead of the reset COM voltage and the reset SEG voltage respectively selected by the liquid crystal driving circuits 25*d* and 27*d*, a voltage of 0 V (GND) is forcibly applied to the liquid crystal of the pixels 12 on all of the scanning electrodes 17 and the data electrodes 19. Then, the liquid crystal 3 of all the pixels 12 is changed from the homeotropic state to the planar state, and all the pixels 12 display white.

At the time point (e) after a predetermined time interval from the time point (d), the driver control circuit 23*a* negates the frame start signal DIO. Then, the driver control circuit 23*a* sequentially transmits m latch pulses LP (latch pulses LP_COM) to the shift register 25*a* of the common driver 25. In addition, the driver control circuit 23*a* outputs the same data electrode reset data Dd (="0b1111") as that applied to the data electrodes 19 during the reset process as 4-bit parallel data in synchronization with the latch pulse LP_COM such that the data can be applied to all the scanning electrodes 17(1 to m), that is, the first (line 1) to last (line m) scanning electrodes 17 of the frame. In this way, the selected states of all the scanning electrodes 17 are reset, and the process of simultaneously resetting all the pixels ends at the time point (f).

As such, the reset period Tr is defined during the period for which the off signal /DSPOF is in the negated state, and the asserted/negated states of the pulse polarity control signal FR are reversed during half the reset period Tr, thereby reversing the polarity of the voltage applied and applying an AC voltage to the liquid crystal 3 of the pixels 12. In this way, it is possible to reset the pixels.

Next, the reset process of the liquid crystal display element 1 when the environmental temperature t (° C.) is the high temperature Hh2 (40<Hh2) will be disclosed with reference to FIG. 14. FIG. 14 shows the output timings (1) to (7) of various signals output from the driver control circuit 23*a* and the waveform (8) of a voltage applied to the liquid crystal, similar to FIG. 13. A description of the same matter as that in FIG. 13 will be omitted.

The driver control circuit 23*a* is instructed beforehand by the CPU 23*b* to set the pulse width ratio Pr to 0.5.

Further, the driver control circuit 23*a* is instructed beforehand by the CPU 23*b* to perform the first mode that asserts the off signal /DSPOF during the time including the time point of the polarity reversal of the pulse waveform at the room temperature Hs. Therefore, the driver control circuit 23*a* controls the off signal /DSPOF such that a voltage applied to the liquid crystal is forcibly turned off during the time including the time point of the polarity switching of the pulse polarity control signal FR, which is set in the middle of the reset period Tr (=60 msec) at the room temperature Hs.

A portion of the reset period Tr for which the off signal /DSPOF is asserted is referred to as a cut off period Toff. When a pulse width Tr2 is required for the high temperature Hh2 in the reset period Tr, the cut off period Toff is Tr−Tr2=(1−0.5)×Tr.

The period from the start of the assertion of the off signal /DSPOF to the time point when the polarity of the pulse polarity control signal FR is switched, which is set in the middle of the reset period Tr, is referred to as a cut off period Toff1, and the period from the time point when the polarity of the pulse polarity control signal FR is switched to the end of the assertion of the off signal /DSPOF is referred to as a cut off period Toff2.

The driver control circuit 23*a* controls the off signal /DSPOF such that Toff=Toff1+Toff2 and Toff1=Toff2=Toff/2 are satisfied, that is, the length of the cut off period Toff1 is equal to that of the cut off period Toff2.

In this way, even at the high temperature Hh2, the CPU 23*b* can output data to the driver control circuit 23*a* with a low load at the same transmission rate as that at which the reset data D is transmitted at the room temperature Hs.

The driver control circuit 23*a* asserts the pulse polarity control signal FR at the time point (c) after the first latch pulse LP1 is output.

Further, the driver control circuit 23*a* negates the off signal /DSPOF at the same time as asserting the pulse polarity control signal FR. In this way, the reset period Tr starts at the time point (c).

When the off signal /DSPOF is negated, the liquid crystal driving circuit 25*d* of the common driver 25 applies reset COM voltages corresponding to the m scanning electrode reset data Dc to m scanning electrodes 17(1 to m). A voltage of +36 V is applied to all the scanning electrodes 17 as the reset COM voltage.

Meanwhile, when the off signal /DSPOF is negated, the liquid crystal driving circuit 27*d* of the segment driver 27 applies reset SEG voltages corresponding to the n data electrode reset data Dd to n data electrodes 19(1 to n). A voltage of 0 V is applied to all the data electrodes 19 as the reset SEG voltage.

Then, the driver control circuit 23*a* asserts the off signal /DSPOF after the front period (Tr2)/2=Tr/4=(0.25)×Tr has elapsed. In this way, the cut off period Toff starts, and instead of the reset COM voltage, a voltage of 0 V (GND) is forcibly output from the liquid crystal driving circuit 25*d*.

When the time reaches the first half Tr/2 of the reset period Tr that is equal to the reset pulse width Tr at the room temperature Hs, that is, at the end of the cut off period Toff 1, the driver control circuit 23*a* inverts the pulse polarity control signal FR to be the negated state. Since the off signal /DSPOF is maintained in the asserted state, the output voltages of the liquid crystal driving circuits 25*d* and 27*d* are maintained at 0 V (GND).

Then, when the cut off period Toff2 has elapsed after the pulse polarity control signal FR was inverted, that is, when the asserted state of the off signal /DSPOF is maintained during the cut off period Toff=(0.5)×Tr after the front period Tr/4 of the reset period has elapsed, the driver control circuit 23*a* changes the off signal /DSPOF to the negated state, and maintains the negated state during the period (Tr2)/2=Tr/4=(0.25)×Tr.

Since the pulse polarity control signal FR is negated, the liquid crystal driving circuit 25*d* of the common driver 25 switches the reset COM voltage applied to all the scanning electrodes 17 from +36 V to 0 V. In this way, a reset COM voltage of +36 V is applied to all the scanning electrodes 17 during the front period Tr/4 of the reset period Tr, and a reset COM voltage of 0 V is applied to all the scanning electrodes 17 during the rear period Tr/4.

When the pulse polarity control signal FR is negated, the liquid crystal driving circuit 27*d* of the segment driver 27 switches the reset SEG voltage applied to all the data electrodes 19 from 0 V to +36 V. In this way, a reset SEG voltage of 0 V is applied to all the data electrodes 19 during the front period Tr/4 of the reset period Tr, and a reset SEG voltage of +36 V is applied to all the data electrodes 19 during the rear period Tr/4.

Therefore, the driving voltage VD applied to the liquid crystal 3 of all the pixels 12(1, 1) to 12(m, n) is +36 V (=the reset COM voltage−the reset SEG voltage=+36 V−0 V) during the front period Tr/4 of the reset period Tr. In addition, the driving voltage VD is −36 V (=the reset COM voltage−the reset SEG voltage=0 V−36 V) during the rear period Tr/4 of the reset period Tr. A driving voltage VD of 0 V is forcibly applied during the cut off period Toff between the front and rear periods of the reset period Tr.

That is, an AC voltage VD of ±36 V is applied to all the pixels 12(1, 1) to 12(m, n) during the pulse width Tr2=(0.5)×Tr at the high temperature Hh2 within the reset period Tr that is equal to the pulse width at the room temperature Hs. When an AC voltage of ±36 V is applied to the cholesteric liquid crystal according to this embodiment during the pulse width Tr2 at the high temperature Hh2, the cholesteric liquid crystal changes to a homeotropic state.

As shown in the time point (d), when the reset period Tr ends, the driver control circuit 23*a* asserts the off signal /DSPOF. In this way, instead of the reset COM voltage and the reset SEG voltage respectively selected by the liquid crystal driving circuits 25*d* and 27*d*, a voltage of 0 V (GND) is forcibly applied to the liquid crystal of the pixels 12 on all of the scanning electrodes 17 and the data electrodes 19. Then, the liquid crystal 3 of all the pixels 12 is changed from the homeotropic state to the planar state, and all the pixels 12 display white.

Thereafter, the process of simultaneously resetting all the pixels ends after the time points (e) and (f).

Next, the reset process of the liquid crystal display element 1 when the environmental temperature t (° C.) is the high temperature Hh2(40<Hh2) will be disclosed with reference to FIG. 15. FIG. 15 shows the output timings (1) to (7) of various signals output from the driver control circuit 23*a* and the waveform (8) of a voltage applied to the liquid crystal, similar to FIG. 14. A description of the same matter as that in FIG. 14 will be omitted.

The driver control circuit 23*a* is instructed beforehand by the CPU 23*b* to set the pulse width ratio Pr to 0.5.

Further, the driver control circuit 23*a* is instructed beforehand by the CPU 23*b* to perform the second mode that negates the off signal /DSPOF during the time including the time point of the polarity reversal of the pulse waveform at the room temperature Hs. Therefore, the driver control circuit 23*a* controls the off signal /DSPOF such that a voltage to be applied to the liquid crystal is output during the time including the time point of the polarity switching of the pulse polarity control signal FR, which is set in the middle of the reset period Tr (=60 msec) at the room temperature Hs. That is, the driver control circuit 23*a* controls the off signal /DSPOF such that the voltage applied to the liquid crystal is forcibly turned off at both sides of the time including the time point of the polarity switching of the pulse polarity control signal FR, which is set in the middle of the reset period Tr at the room temperature Hs.

A portion of the reset period Tr for which the off signal /DSPOF is asserted is referred to as a cut off period Toff. When a pulse width Tr2 is required for the high temperature Hh2 in the reset period Tr, the cut off period Toff is Tr−Tr2=(1−0.5)×Tr.

The cut off period Toff includes a cut off period Toff1 and a cut off period Toff2 that are set at both sides of the time including the time point of the polarity switching of the pulse polarity control signal FR.

The driver control circuit 23*a* controls the off signal /DSPOF such that Toff=Toff1+Toff2 and Toff1=Toff2=Toff/2 are satisfied, that is, the length of the cut off period Toff1 is equal to that of the cut off period Toff2.

In this way, even at the high temperature Hh2, the CPU 23*b* can output data to the driver control circuit 23*a* with a low load at the same transmission rate as that at which the reset data D is transmitted at the room temperature Hs.

The driver control circuit 23*a* asserts the pulse polarity control signal FR at the time point (c) after the first latch pulse LP1 is output. In addition, the driver control circuit 23*a* asserts the off signal /DSPOF until the time point (c). In this way, the reset period Tr starts at the time point (c).

After the off signal /DSPOF is maintained in the asserted state during the cut off period Toff1=(0.25)×Tr on the basis of the time point (c), the driver control circuit 23*a* switches the off signal /DSPOF to the negated state, and maintains the negated state during the reset period Tr2=(0.5)×Tr.

Since the off signal /DSPOF is in the asserted state, a voltage of 0 V (GND) is forcibly output from the liquid crystal driving circuits 25*d* and 27*d* during the cut off period Toff 1.

Then, the driver control circuit 23*a* negates the off signal /DSPOF immediately after the cut off period Toff1 has elapsed. In this way, the liquid crystal driving circuit 25*d* of the common driver 25 applies reset COM voltages corresponding to m scanning electrode reset data Dc to m scanning electrodes 17(1 to m). A voltage of +36 V is applied to all the scanning electrodes 17 as the reset COM voltage.

Meanwhile, since the off signal /DSPOF is negated, the liquid crystal driving circuit 27*d* of the segment driver 27 applies reset SEG voltages corresponding to n data electrode reset data Dd to n data electrodes 19(1 to n). A voltage of 0 V is applied to all the data electrodes 19 as the reset SEG voltage.

Then, the driver control circuit 23*a* inverts the pulse polarity control signal FR to be the negated state at the end of the first half Tr/2 of the reset period Tr.

The off signal /DSPOF is maintained in the negated state. Therefore, when the pulse polarity control signal FR is negated, the liquid crystal driving circuit 25*d* of the common driver 25 switches the reset COM voltage applied to all the scanning electrodes 17 from +36 V to 0 V.

After the off signal /DSPOF is maintained in the negated state during the period Tr2, the driver control circuit 23*a* switches the off signal /DSPOF to the negated state, and maintains the state at least during the cut off period Toff2=(0.25)×Tr.

In this way, a voltage of +36 V is applied to all the scanning electrodes 17 during the first half of the period Tr2 of the reset period Tr, and a voltage of 0 V is applied to all the scanning electrodes 17 during the second half of the period Tr2. A voltage of 0 V is forcibly applied to all the scanning electrodes 17 during the front and rear cut off periods Toff1 and Toff2 of the reset period Tr.

Since the pulse polarity control signal FR is negated, the liquid crystal driving circuit 27*d* of the segment driver 27 switches the reset SEG voltage applied to all the data electrodes 19 from 0 V to +36 V. In this way, a voltage of 0 V is applied to all the data electrodes 19 during the first half of the period Tr2 of the reset period Tr, and a voltage of +36 V is applied to all the data electrodes 19 during the second half. A voltage of 0 V is forcibly applied to all the data electrodes 19 during the front and rear cut off periods Toff1 and Toff2 of the reset period Tr.

Therefore, the driving voltage VD applied to the liquid crystal 3 of all the pixels 12(1, 1) to 12(m, n) is +36 V (=the reset COM voltage−the reset SEG voltage=+36 V−0 V) during the first half of the period Tr2. In addition, the driving voltage VD is −36 V (=the reset COM voltage−the reset SEG voltage=0 V−36 V) during the second half of the period Tr2. A driving voltage VD of 0 V is forcibly applied during the front and rear cut off periods Toff1 and Toff2 of the reset period Tr.

That is, an AC voltage VD of ±36 V is applied to all the pixels 12(1, 1) to 12(m, n ) during the pulse width Tr2=(0.5)×Tr at the high temperature Hh2 within the reset period Tr that is equal to the pulse width at the room temperature Hs. When an AC voltage of ±36 V is applied to the cholesteric liquid crystal according to this embodiment during the pulse width Tr2 at the high temperature Hh2, the cholesteric liquid crystal changes to a homeotropic state.

The driver control circuit 23*a* asserts the off signal /DSPOF at the end of the pulse width Tr2. In this way, instead of the reset COM voltage and the reset SEG voltage respectively selected by the liquid crystal driving circuits 25*d* and 27*d*, a voltage of 0 V (GND) is forcibly applied to the liquid crystal of the pixels 12 on all of the scanning electrodes 17 and the data electrodes 19. Then, the liquid crystal 3 of all the pixels 12 is changed from the homeotropic state to the planar state, and all the pixels 12 display white.

Thereafter, the process of simultaneously resetting all the pixels ends after the time points (e) and (f).

The description of the high temperature Hh2 during the reset process shown in FIGS. 14 and 15 may similarly be applied to the high temperature Hh1.

As disclosed above, according to this embodiment, the processor can perform the same pulse width modulation control process as that at the room temperature to optimally display images at high temperature. Since the processor can transmit image data to the driver control circuit at the same transmission rate as that at the room temperature, it is possible to correct liquid crystal characteristics at high temperature without significantly increasing a processing load of the processor. In addition, it is not necessary to provide a high-speed transmission driver and receiver, and a multiple power supply circuit using, for example, a voltage modulation method. As a result, it is possible to manufacture an apparatus at low manufacturing costs.

(Detailed Structure of Liquid Crystal Display Element 1)

Next, the detailed structure of the liquid crystal display element 1 according to this embodiment and a method of manufacturing the same will be disclosed. In this embodiment, the upper and lower transparent substrates 7 and 9 are two polycarbonate (PC) film substrates each having a rectangular shape of, for example, 10 cm×8 cm. Alternatively, glass substrates or film substrates, such as polyethylene terephthalate (PET), may be used instead of the PC substrates. These film substrates have sufficient flexibility. In this embodiment, both the upper substrate 7 and the lower substrate 9 have light transmittance, but the embodiment is not limited thereto. Instead of the light absorbing layer 15, the lower substrate 9 may be formed of an opaque material.

For example, the scanning electrodes 17 and the data electrodes 19 are generally formed of indium tin oxide (ITO). However, the electrodes 17 and 19 may be formed of a transparent conductive material, such as indium zinc oxide (IZO), or a photoconductive material, such as amorphous silicon.

In this embodiment, transparent electrodes are patterned to form 320 stripe-shaped scanning electrodes 17 and 240 stripe-shaped data electrodes 19 at pitches of 0.24 mm in order to support a QVGA resolution of, for example, 320×240 dots.

As nematic liquid crystal, various known liquid crystal materials may be used. It is preferable to use a cholesteric liquid crystal compound having dielectric anisotropy $\Delta\in$ satisfying $20 \leqq \Delta\in \leqq 50$. When the dielectric anisotropy $\Delta\in$ is equal to or larger than 20, the selection range of an available chiral material is widened. When the dielectric anisotropy $\Delta\in$ is excessively smaller than the range, a driving voltage for the liquid crystal layer increases. On the other hand, when the dielectric anisotropy $\Delta\in$is excessively larger than the range, the stability and reliability of the liquid crystal display element are lowered, and an image defect or image noise is likely to occur.

The refractive index anisotropy $\Delta n$ of the cholesteric liquid crystal is an important physical property that has a great affect on image quality. It is preferable that the value of the refractive index anisotropy $\Delta n$ satisfy $0.18 \leqq \Delta n \leqq 0.24$. When the refractive index anisotropy $\Delta n$ is smaller than the range, the reflectance of the liquid crystal 3 in the planar state is lowered, and brightness is reduced, which results in dark display. On the other hand, when the refractive index anisotropy $\Delta n$ is larger than the range, diffuse reflection from the liquid crystal 3 in the focal conic state increases. As a result, the color purity and contrast of a display screen are lowered. In addition, when the refractive index anisotropy An is larger than the range, viscosity increases, which results a reduction in the response speed of the cholesteric liquid crystal.

It is preferable that the specific resistance $\rho$ of the cholesteric liquid crystal satisfy $10^{10} \leqq \rho \leqq 10^{13}$ ($\Omega\cdot$cm). In addition, it is preferable that the viscosity of the cholesteric liquid crystal be low in order to prevent a reduction in contrast or an increase in voltage at low temperature.

As functional films, insulating films (not shown) or alignment films (not shown) for controlling the alignment of liquid crystal molecules may be applied (coated) on both the electrodes 17 and 19. The insulating films prevent a short circuit between adjacent electrodes, or serve as gas barrier layers to improve the reliability of the liquid crystal display element 1. In addition, the alignment films may be formed of a polyimide resin or an acrylic resin. In the above-disclosed embodiment, the alignment films are formed on the entire surfaces of the electrodes on the substrates. The alignment films may also serve as the insulating films.

Further, it is necessary to maintain the thickness (cell gap) d of the liquid crystal 3 to be constant. In order to maintain a predetermined cell gap d, spherical spacers made of resin or inorganic oxide are dispersed in the liquid crystal 3, or a plurality of pillar spacers with surfaces coated with a thermoplastic resin are formed in the liquid crystal 3. In the liquid crystal display element 1 according to the above-disclosed embodiment, spacers (not shown) are provided in the liquid crystal layer to maintain a constant cell gap d. In addition, it is preferable to form an adhesive wall structure around the pixels. It is preferable that the cell gap d satisfy $3\ \mu m \leqq d \leqq 6\ \mu m$. When the cell gap d is smaller than the range, the reflectance of the liquid crystal 3 for green (G) in the planar state is lowered. When the cell gap is larger than the range, an excessively high driving voltage is required. In the above-disclosed embodiment, the cell gap d is set to 4 μm.

For example, general-purpose STN driver ICs having a TCP (tape carrier package) structure are used as scanning electrode and data electrode driving ICs.

Figure 16A:
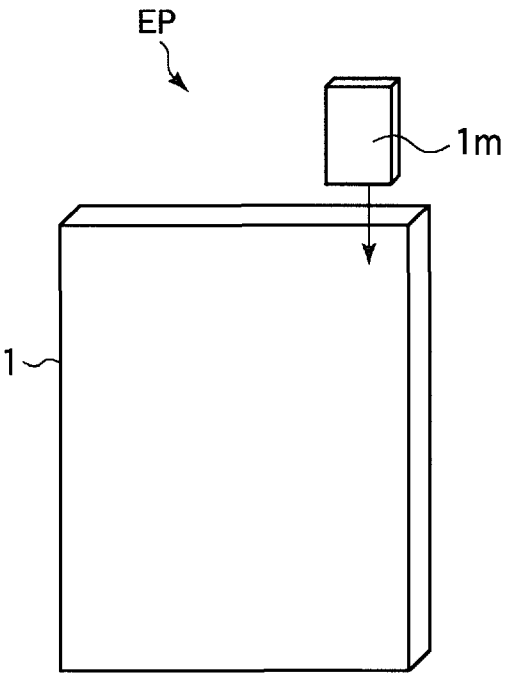
FIGS. 16A to 16C are diagrams illustrating detailed examples of an electronic paper EP provided with the liquid crystal display element according to the embodiment.
Figure 16B:
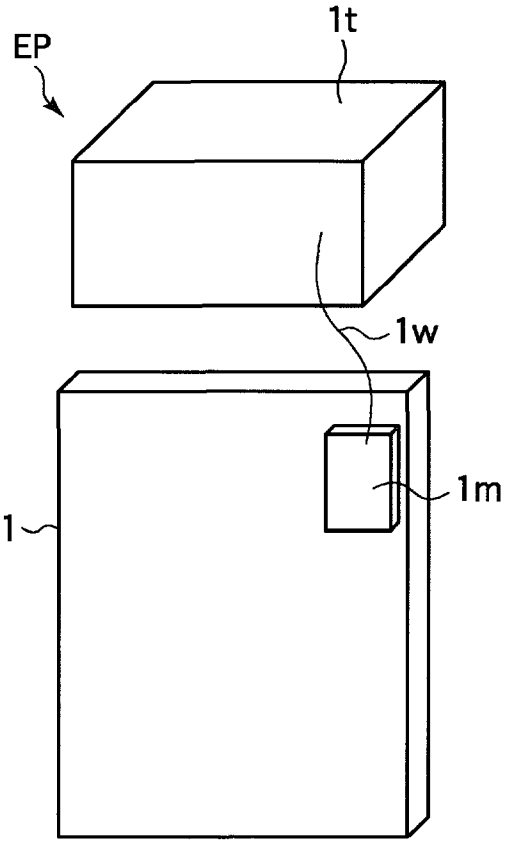
Figure 16C:
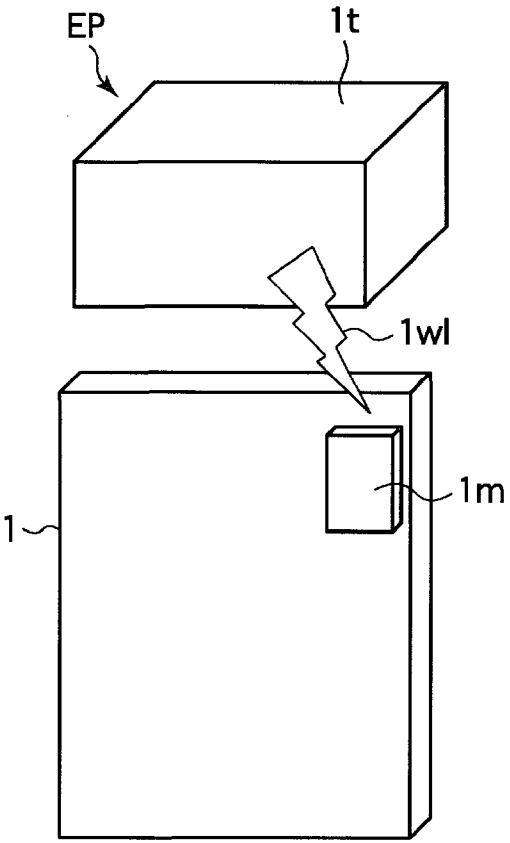

Input and output devices (not shown) and a control device (not shown) for controlling the overall operation are provided in the manufactured liquid crystal display element 1, thereby completing an electronic paper. FIGS. 16A to 16C show detailed examples of an electronic paper EP provided with the liquid crystal display element 1 according to this embodiment. FIG. 16A shows the electronic paper EP having a structure in which a non-volatile memory 1*m* having image data stored therein beforehand is provided in the liquid crystal display element 1 according to this embodiment. For example, it is possible to display an image by transferring image data stored in, for example, a personal computer to the non-volatile memory 1*m* and mounting the non-volatile memory 1*m* to the electronic paper EP.

FIG. 16B shows the electronic paper EP having a structure in which the non-volatile memory 1*m* is provided in the liquid crystal display element 1 according to this embodiment. For example, it is possible to display an image by transmitting image data stored in a terminal 1*t* (the terminal 1*t* may be a component of the electronic paper EP) to the non-volatile memory 1*m* by wire.

FIG. 16C shows an example in which the terminal it and the liquid crystal display element 1 have wireless transmitting/receiving systems (for example, a wireless LAN or Bluetooth). It is possible to display an image by transmitting image data stored in the terminal 1*t* to the non-volatile memory 1*m* by wireless communication 1*w*1.

The invention is not limited to the above-disclosed embodiment, but various modifications and changes of the invention can be made without departing from the scope and spirit of the invention.

In the above-disclosed embodiment, the liquid crystal display element 1 selectively reflects green light, but the invention is not limited thereto. The invention may be similarly applied to a liquid crystal display element having cholesteric liquid crystal that selectively reflects red or blue light. In addition, it is possible to manufacture a color liquid crystal display element by laminating a red liquid crystal display element that selectively reflects red light, a green liquid crystal display element that selectively reflects green light, and a blue liquid crystal display element that selectively reflects blue light and providing a light absorbing layer on the lower surface of the laminated structure. Further, the driving method of the invention may be applied to each of the liquid crystal display elements. In this case, it is possible to optimally display images at low manufacturing costs even when the temperature of the liquid crystal is relatively high.

What is claimed is:

1. A method of driving a liquid crystal display element that applies an AC pulse voltage to drive liquid crystal, the method comprising:

comparing the temperature of the liquid crystal with a reference temperature;

when the temperature of the liquid crystal is higher than the reference temperature, generating the AC pulse voltage for a high temperature having a pulse width that is shorter than a reference pulse width of a reference AC pulse voltage used at the reference temperature; and applying the AC pulse voltage for the high temperature to the liquid crystal in a period that is equal to the reference pulse width, wherein the AC pulse voltage for the high temperature is generated by a voltage cut off signal that forcibly turns off the voltage level of the reference AC pulse voltage during an arbitrary period.

2. The method of driving the liquid crystal display element according to claim 1, wherein the voltage cut off signal is asserted during the time which includes a time point of the polarity reversal of the reference AC pulse voltage.

3. The method of driving the liquid crystal display element according to claim 2, wherein the period from the start of the assertion of the voltage cut off signal to the time point of the polarity reversal is equal to the period from the time point of the polarity reversal to the end of the assertion of the voltage cut off signal.

4. The method of driving the liquid crystal display element according to claim 1, wherein the voltage cut off signal is asserted at both sides of the time which includes a time point of the polarity reversal of the reference AC pulse voltage.

5. The method of driving the liquid crystal display element according to claim 4, wherein the voltage cut off signal is asserted during a first period from a start of the reference AC pulse voltage to a first time before the polarity reversal and during a second period from a second time after the polarity reversal to an end of the reference AC pulse voltage.

6. The method of driving the liquid crystal display element according to claim 5, wherein the first period and the second period have the same length.

7. The method of driving the liquid crystal display element according to claim 1, wherein the reference temperature is a room temperature.

8. The method of driving the liquid crystal display element according to claim 2, wherein the polarity reversal occurs in the middle of the reference pulse width.

9. The method of driving the liquid crystal display element according to claim 1, wherein the liquid crystal is cholesteric liquid crystal.

10. The method of driving the liquid crystal display element according to claim 9, wherein the liquid crystal changes to a planar state that selectively reflects a specific light wavelength in a reset process.

11. The method of driving the liquid crystal display element according to claim 1, wherein the transmission rate of image data to a control unit that generates the AC pulse voltage for a high temperature at a temperature that is higher than the reference temperature is equal to that at the reference temperature.

12. A liquid crystal display element for applying an AC pulse voltage to liquid crystal to display an image, comprising:

a control unit that, when the temperature of the liquid crystal is higher than a reference temperature, generates an AC pulse voltage for a high temperature having a pulse width that is shorter than a reference pulse width of a reference AC pulse voltage used at the reference temperature; and a driver that applies the AC pulse voltage for the high temperature to the liquid crystal in a period that is equal to the reference pulse width, wherein the control unit generates the AC pulse voltage for the high temperature using a voltage cut off signal that forcibly turns off the voltage level of the reference AC pulse voltage during an arbitrary period.

13. The liquid crystal display element according to claim 12, wherein the voltage cut off signal is asserted during the time which includes a time point of the polarity reversal of the reference AC pulse voltage.

14. The liquid crystal display element according to claim 13, wherein the period from the start of the assertion of the voltage cut off signal to the time point of the polarity reversal is equal to the period from the time point of the polarity reversal to the end of the assertion of the voltage cut off signal.

15. The liquid crystal display element according to claim 12, wherein the voltage cut off signal is asserted at both sides of the time which includes a time point of the polarity reversal of the reference AC pulse voltage.

16. The liquid crystal display element according to claim 15, wherein the voltage cut off signal is asserted during a first period from a start of the reference AC pulse voltage to a first time before the polarity reversal and during a second period from a second time after the polarity reversal to an end of the reference AC pulse voltage.

17. The liquid crystal display element according to claim 16, wherein the first period and the second period have the same length.

18. An electronic paper for displaying an image comprising:

the liquid crystal display element according to claim 12.

* * * * *